US006495962B2

(12) United States Patent
Uemura et al.

(10) Patent No.: US 6,495,962 B2
(45) Date of Patent: Dec. 17, 2002

(54) METAL HALIDE LAMP AND A VEHICLE LIGHTING APPARATUS USING THE LAMP

(75) Inventors: Kozo Uemura, Kanagawa-ken (JP); Toshihiko Ishigami, Kanagawa-ken (JP); Toshio Hiruta, Kanagawa-ken (JP); Mikio Matsuda, Tokyo (JP); Shigehisa Kawatsuru, Yokosuka (JP); Isao Yamazaki, Tokyo (JP); Akio Ishizuka, Yokohama (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 32 days.

(21) Appl. No.: 09/842,921

(22) Filed: Apr. 27, 2001

(65) Prior Publication Data

US 2002/0158580 A1 Oct. 31, 2002

(30) Foreign Application Priority Data

Apr. 28, 2000 (JP) ..... 2000-130603
Apr. 28, 2000 (JP) ..... 2000-130604

(51) Int. Cl.[7] ..... H01J 17/04
(52) U.S. Cl. ..... 315/77; 313/620
(58) Field of Search ..... 315/77, 82, 56, 315/246; 313/567, 579, 620, 634

(56) References Cited

U.S. PATENT DOCUMENTS 4,594,529 A * 6/1986 de Vrijer ..... 313/113
4,929,863 A * 5/1990 Verbeek et al. ..... 313/113
5,138,228 A * 8/1992 Thomas et al. ..... 313/284
5,239,230 A * 8/1993 Mathews et al. ..... 313/571
5,256,940 A * 10/1993 Wada et al. ..... 313/640
5,481,159 A * 1/1996 Hiramoto et al. ..... 313/568
6,084,351 A * 7/2000 Kai et al. ..... 313/570
6,094,008 A * 7/2000 Omori et al. ..... 313/25
6,215,254 B1 * 4/2001 Honda et al. ..... 313/623
6,274,983 B1 * 8/2001 Ooyama et al. ..... 313/631
6,353,289 B1 * 3/2002 Ishigami et al. ..... 313/568
6,400,076 B1 * 6/2002 Allen et al. ..... 313/572

* cited by examiner

*Primary Examiner*—Don Wong
*Assistant Examiner*—Minh D. A
(74) *Attorney, Agent, or Firm*—Pillsbury Winthrop LLP

(57) ABSTRACT

A metal halide lamp comprises a light-transmitting discharge vessel having a discharge space portion, a sealed portion, and a pair of electrodes projecting into the discharge space. The discharge vessel is constructed and arranged to have a D/L ratio being in a range of about 0.25 to about 1.5 and a t/L ratio being in a range of about 0.16 to about 1.1, wherein L is an interspace of tips of the electrodes, D is a maximum inner diameter of the discharge vessel, and t is a maximum wall thickness of the discharge space portion. An ionizable filling contains a rare gas and a metal halide including at least sodium (Na) or scandium (Sc) and does not substantially include mercury (Hg). Each of conductive wires is connected electrically to the electrodes extending from the discharge vessel. The metal halide lamp may be used for a metal halide lamp apparatus or a vehicle lighting apparatus.

10 Claims, 15 Drawing Sheets

METAL HALIDE LAMP AND A VEHICLE LIGHTING APPARATUS USING THE LAMP

BACKGROUND OF THE INVENTION

1. Field of the Invention

The present invention relates to a metal halide lamp substantially not including mercury (Hg), a metal halide lamp apparatus and a vehicle lighting apparatus using the lamp.

2. Description of Related Art

Generally, a metal halide lamp is provided with a discharge vessel filled with an ionizable gas filling including a rare gas, a metal halide, and mercury (Hg). Such a metal halide lamp is practical for use in various light fixtures because of its high efficacy and good color rendering properties.

Particularly, in the view of its high efficacy and a color rendering, it is suitable for such a metal halide lamp to be improved. When the metal halide lamp is used as a vehicle headlight, it must be able to pass a brightness test. The brightness of the lamp shining on a screen must reach a predetermined luminous flux after a predetermined time has elapsed after the vehicle headlight turned on. According to Japan Electrical Lamp Manufactures Association Standard No. 215 (hereinafter JEL-215), a lamp for a vehicle headlight is required to generate its rated luminous flux of 25% one second after the lamp turned on. It is further required to generate its rated luminous flux of 80% four seconds after the lamp turned on.

The mercury (Hg) of a metal halide lamp having mercury (Hg) and a metal halide, primarily emits about four seconds after the lamp is lit. Four seconds later, the metal halide starts to emit, so that the lamp starts to increase its luminous flux. The luminous efficacy of mercury (Hg) is half of that of the metal halide. Therefore, the lamp must be supplied twice as much power as that of an ordinary lamp in order to increase the luminous flux to an acceptable level within four seconds after the lamp turned on. For example, in case of applying the lamp having mercury (Hg) to the vehicle headlight, the lamp lights at a rated luminous flux of 25% in one second, and the lamp can emit the rated luminous flux of 100% in four seconds. However, color characteristics, e.g., a color rendering property or a chromaticity is not good during the initial few seconds after the lamp started. For example, the lamp has an out of white color region on the chromaticity diagram at the beginning of lamp operation. It takes about ten seconds for the lamp's chromaticity to get into the white color region. Furthermore, for this type of lamp, luminous flux slowly increases at the beginning of lamp operation in comparison with that of a halogen incandescent lamp. If the electrical power is further supplied to the lamp in order to increase luminous flux, it is likely to overshoot the desired steady state level of luminous flux because of increased mercury (Hg) evaporation during the initial second after the lamp turned on. Accordingly, in the view of a initial luminous flux of the lamp, it is difficult for the metal halide lamp having mercury (Hg) to be used as a vehicle headlight.

A metal halide lamp is disclosed in U.S. Pat. No. 4,594,529 (prior art 1). A gas discharge lamp is suitable for using with a reflector as a vehicle headlight. The gas discharge lamp comprises a lamp envelope made of quartz glass having an elongate discharge space. Electrodes are arranged near both sides of the an elongate discharge space. Current-supply conductors, connected to respective electrodes, extend outwardly from vacuum-tight seals.

The lamp envelope is filled with an ionizable gas filling including a rare gas, mercury (Hg), and a metal halide. The lamp envelope has a wall thickness (t) of 1.5 mm to 2.5 mm, and an inner diameter (D) of 1 mm to 3 mm at the midway point between the electrodes. The distance (d) between the tips of the electrodes is 3.5 mm to 6 mm. Each of the electrodes projects a length (l) of 0.5 mm to 1.5 mm into the lamp envelope. The quantity A (mg) of mercury (Hg) used in the lamp is determined as follows: $0.002*(d+4*l)*D^2 \leqq A \leqq 0.2(d+4*l)*D^{1/3}$, wherein the inner diameter (D), the distance (d), and length (l) are expressed in mm. Prior art 1 describes a metal halide lamp, which is horizontally arranged. The lamp operates with high efficiency and contains mercury (Hg) in its bulb. However, mercury (Hg) is harmful to our environment and the amount of mercury used in bulbs should be reduced. Also the arc formed by discharge in the bulb is not vertically spread as desired. Rather, the arc height is contracted. Metal halide lamps not including mercury (Hg) (called a mercury less or a mercury free lamp) are disclosed in Japanese Patent 2,982,198 (prior art 2), Japanese Laid Open Application HEI 6-84,496 (prior art 3), HEI 11-238,488 (prior art 4), or HEI 11-307,048 (prior art 5).

According to the prior art 2, a metal halide lamp is filled with either scandium (Sc) halide or a rare metal halide and a rare gas, and is ignited by a pulse current. The metal halide lamp described in prior art 3 has a metal halide and a rare gas so that its color characteristics do not change even if a dimmer controls the lamp. According to prior art 4, a metal halide lamp can be configured to further include another kind of metal halide (a secondary metal halide), e.g., magnesium (Mg) halide, in addition to its primary metal halide in order to improve its electrical characteristics. The metal halide lamp of prior art 5 includes yet another metal halide (a third metal halide), e.g., indium (In) or yttrium (Y) halide, which has an ionization voltage of 5 to 10 eV and an operational vapor pressure of $1\times10^{-5}$ atm, in addition to scandium (Sc) halide and sodium (Na) halide. The electrodes of this metal halide lamp do not evaporate too much, so that a discharge vessel does not easily blacken.

In the case of a metal halide lamp not including mercury (Hg), a rare gas primarily slightly illuminates about four seconds after the lamp turned on. The luminous efficacy of the rare gas is lower than that of mercury (Hg). Accordingly, even if the lamp is supplied twice as much power as that of an ordinary lamp in order to increase its luminous flux in four seconds or more, after the lamp turned on, the lamp can not satisfy the aforementioned regulation of JEL-215 sufficiently.

SUMMARY

The inventions claimed herein describe metal halide lamps, metal halide lamp apparatus, and vehicle lighting apparatus.

In one embodiment of the invention, a metal halide lamp includes a light-transmitting discharge vessel having a sealed portion, and a pair of electrodes projecting into a discharge space of the vessel. Its (D/L) ratio is in the range of about 0.25 to about 1.5, and a t/L ratio is within about 0.16 to about 1.1, wherein L is an interspace of tips of the electrodes, D is a maximum inner diameter thereof, and t is a maximum wall thickness of the discharge space portion. An ionizable gas filling, which contains a rare gas and a metal halide including at least sodium (Na) or scandium (Sc) and not substantially including mercury (Hg), fills in the discharge vessel. Conductive wires electrically connect to respective electrodes and extend from the discharge vessel.

The inventions also include a metal halide lamp apparatus. A metal halide lamp apparatus includes a metal halide lamp and a ballast. The ballast has a relation between a filling pressure X (atm) of xenon (Xe), and a maximum electrical power AA(W) according to the following formula:

$$3<X<15,\ AA \geqq -2.5X+102.5,$$

wherein the maximum electrical power AA (W) is a maximum wattage supplied to the lamp in four seconds after the lamp turned on.

The inventions presented herein include a vehicle lighting apparatus. A vehicle lighting apparatus includes a metal halide lamp, a reflector accommodating the metal halide lamp, a front cover arranged to an opening of the reflector, and a ballast.

These and other aspects of the invention are further described in the following drawings and detailed description of the invention.

BRIEF DESCRIPTION OF THE DRAWINGS

The invention will be described in more detail by way of examples illustrated by drawings in which.

DETAILED DESCRIPTION

Figure 1:
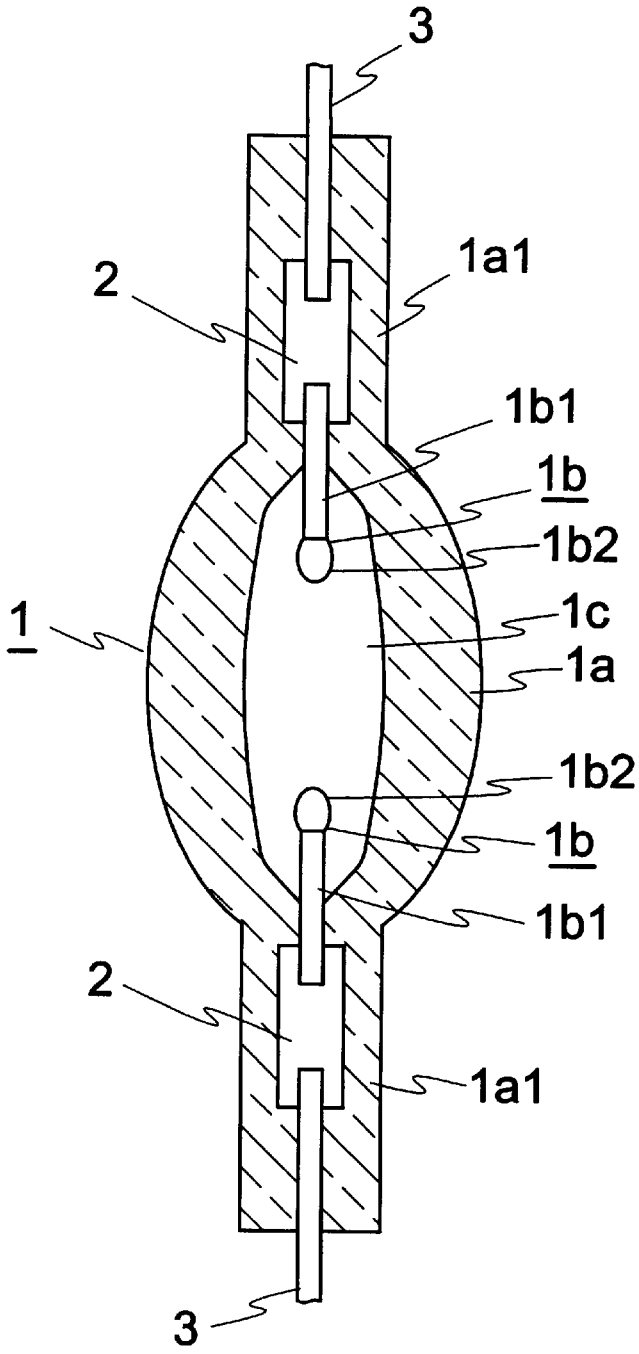
FIG. 1 is a longitudinal section of a metal halide lamp according to a first embodiment of the present invention.

A first exemplary embodiment of the invention will be explained in detail with reference to FIGS. 1 to 4. A metal halide lamp shown in FIG. 1 is provided with a discharge vessel 1 having sealed portions 1*a*1 and electrodes 1*b* disposed in the discharge vessel 1. Each of molybdenum foils 2 is connected to a respective electrode 1*b*. Furthermore, each of outer conductive wires 3 is connected to a respective molybdenum foil 2.

The discharge vessel 1, made of quartz glass, has an ellipsoid-shaped portion 1*a* surrounding a discharge space 1*c*, and sealed portions 1*a*1 continuously formed with the ellipsoid-shape portion 1*a*. The thickness of the ellipsoid-shape portion 1*a* may change from portion to portion thereof as appropriate for size, shape, etc.

Each of electrodes 1*b* is made of tungsten and includes an electrode rod 1*b*1 and a tip portion 1*b*2, the diameter of which is larger than that of the electrode rod 1*b*1. The other end of each electrode rod 1*b*1 is embedded in the sealed portion 1*a*1 to connect to the molybdenum foil 2. Each of electrodes 1*b* may be the same structure when an alternating current power is supplied to the metal halide lamp.

When the metal halide lamp is used as a vehicle lighting apparatus, it is preferable that the diameter of the tip portion 1*b*2 is larger than that of a part of the electrode rod 1*b*1 embedded in the seal 1*a*1. In general, a metal halide lamp for a vehicle is turned ON and OFF in many times. Thus, there is substantial current flow through electrode rod 1*b*1 embedded in the sealed portion 1*a*1 each time the lamp is turned ON. Therefore, the glass of the discharge vessel 1 may crack at a portion near the embedded electrode rod 1*b*1, because the electrode rod 1*b*1 alternately expands and contracts when the lamp is turned ON and OFF. If the outer diameter of the part of the embedded electrode rod 1*b*1 is made large, the surface area of the part contacting the sealed portion 1*a*1 becomes large. Therefore, it is easy for a crack to occur. In this embodiment, the glass does not easily crack because the outer diameter of the embedded electrode rod 1*b*1 is smaller than that of the tip portion 1*b*2.

One end of each of outer conductive wires 3 is embedded in the sealed portion 1*a*1 to connect the molybdenum foil 2. The other end of each of conductive wires 3 extends from the discharge vessel 1. The discharge vessel 1 may be made of a light transmissible substance, e.g., quartz glass, alumina, or ceramics. The discharge vessel 1 may optionally have a transparent film on the inner surface thereof to prevent the glass of the vessel from being contaminated by the filling gas including halogen.

The discharge vessel 1 is filled with an ionizable filling containing a metal halide and a rare gas. The metal halide includes one or more selected from a group of sodium (Na), scandium (Sc) and other rare earth elements. A halogen may be one or more selected from a group of fluorine (F), chlorine (Cl), bromide (Br), and iodide (I). The amount of metal halides should be in the range of about 5 mg to about 110 mg per 1 cc by a volume of the discharge space 1*c*. The metal halide lamp may include rare earth metal halide, e.g., dysprosium iodide ($DyI_3$) in order to appropriately adapt visible light to a white range in the chromaticity diagram. During operation, the metal halide lamp not including mercury (Hg) has lower pressure of 6~10 atm of a rare gas than that of the lamp having mercury (Hg). This helps to prevent the lamp's discharge vessel from breaking.

Figure 2:
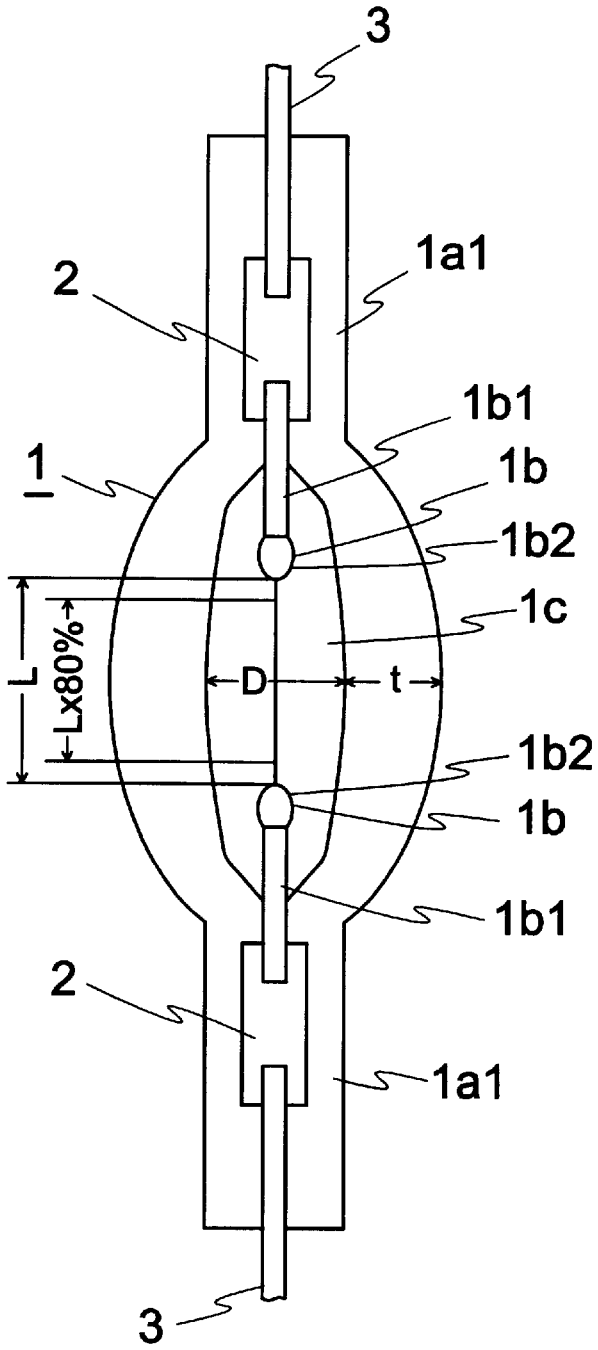
FIG. 2 is a side view of the metal halide lamp shown in FIG. 1.

FIG. 2 shows dimensions of the metal halide lamp. Reference characters are defined as follows:

L is an interspace of tips of electrodes 1*b*.

D is a maximum inner diameter of the discharge vessel 1.

t is a maximum wall thickness of the ellipsoid-shape portion 1*a*.

It is suitable that the maximum inner diameter (D) and the maximum thickness (t) are in a range of 80% of the interspace (L) shown in FIG. 2 except for adjacent to each tip of the electrodes. In order to increase the temperature of the discharge vessel 1, the discharge vessel 1 is formed so that it's walls are close to an arc discharge generated within the vessel. However, it is not easy to increase the temperature adjacent to the electrode tips, i.e., within 10% of the interspace (L) between the tips. Because, the arc discharge tends to occur apart from both electrode tips, the temperature around the tips 1*b*2 does not easily increase, comparatively.

When the D/L ratio is in the range of about 0.25 to about 1.5, the arc discharge of the discharge vessel can increase the temperature of the discharge vessel 1. The center of the arc discharge is adjacent to the inner surface of the discharge vessel 1 so that heat of the arc discharge increasingly conducts to the discharge vessel 1. Therefore, the temperature of the discharge vessel 1 rises appropriately and uniformly. The preferred D/L ratio is in a range of about 0.30 to about 1.05. A range of about 0.45 to about 0.9 is even more preferable. If the D/L ratio is over about 1.5, the heat conduction does not increase sufficiently. When the D/L ratio is under about 0.25, the temperature of the discharge vessel increases excessively. Then, discharge vessel 1 expands inappropriately. If the discharge vessel is made of quartz glass, its transparency decreases because of crystallizing.

When the t/L ratio is about 0.16 to about 1.1, the temperature of the discharge vessel 1 increase quickly and properly. In general the t/L ratio should be in the range of about 0.21 to about 0.77. A range of about 0.31 to about 0.57 is more preferable. If the t/L ratio is over about 1.1, a heat capacity increases excessively. When the t/L ratio is under about 0. 16, the wall thickness of the discharge vessel 1 becomes too thin and heat conducted from the arc discharge, diffuses outwardly through the discharge vessel 1.

A metal halide lamp, according to this embodiment, that is supplied with electrical power of 100 W or less, is arranged horizontally. When the lamp operates, a liquid halide H shown in FIG. 3 adheres to the inner surface of the discharge vessel 1 over an angular area of about +80 degrees to about −80 degrees from a vertical line through the axis of discharge vessel 1.

As the temperature of the discharge vessel 1 rises appropriately and uniformly, the temperature of the liquid halide H rises, so that the metal halide evaporates quickly and a luminous flux rises quickly. When the metal halide contains about 30~about 55 mg per 1 cc by a volume of the discharge space, the luminous flux rises quickly.

Figure 3:
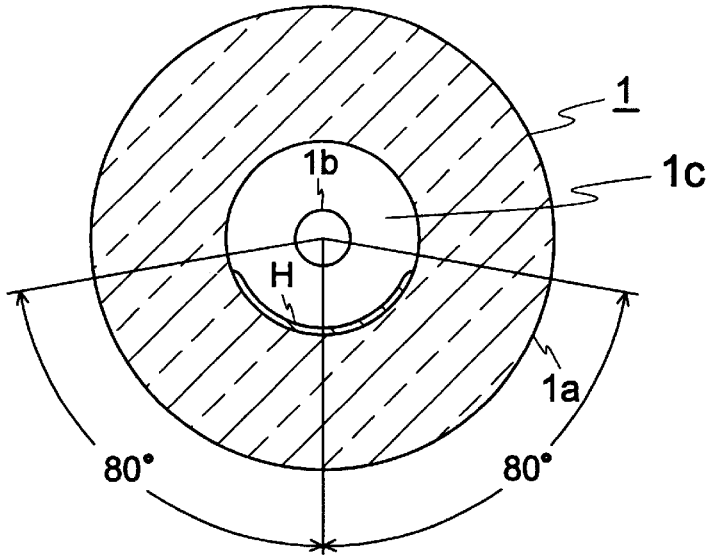
FIG. 3 is a cross section of a discharge vessel of the metal halide lamp shown in FIG. 1.

If a region of the liquid halide H shown in FIG. 3 becomes larger compared with an area of the discharge space, visible light passing through the region changes colors. Therefore, in order to irradiate a good color of visible light from the discharge vessel, it is preferable that the metal halide constitutes about 5~about 35 mg/cc by a volume of the discharge space.

According to an experiment, the amount of the adhering metal halide increases in proportion to the wall thickness of the discharge vessel 1. When a quantity q (mg/cc) of the metal halide in the discharge vessel is as follows:

$q \leqq 71.4/t$, wherein q is a quantity (mg) per 1 cc of the discharge space, and t is a maximum thickness adjacent to the center of the discharge vessel, the visible light passing through the region does not easily change colors.

The area adhered by liquid halide on the inner surface of the discharge vessel 1 is preferably the area defined by an angle of about +80 degrees to about −80 degrees from a vertical line passing through the horizontal axis of vessel 1. This angular region applies during lamp operation. However, it may be measured when the lamp is not operating because the region occupied by the liquid halide is not significantly different when the lamp is not being operated.

In general, since the metal halide adhering to the inner surface changes into liquid phase during lamp operation, visible light passing through this region changes colors due to the liquefied metal halide. For example, the metal halide of Sc—Na—I composition changes visible light into green or yellow, so that the chromaticity is not suitable for a vehicle lighting apparatus. In this case, a screen is disposed along a region corresponding to the liquefied metal halide in the discharge vessel. Light (not needed) passing through the metal halide is blocked by the screen. The quantity q (mg/cc) of the metal halide in the discharge vessel may be as follows: $q \leqq 30.6/t$. In this case, the region adhering liquid halide is decreased, so that the screen can sufficiently block the needless light.

The lamp may further include another metal halide (a secondary metal halide) in order to improve the lamp's electrical characteristics. The secondary metal halide, disclosed in Japanese Laid Open Application HEI 11-238488 can use one metal or more selected a group of magnesium (Mg), iron (Fe), cobalt (Co), chromium (Cr), zinc (Zn), nickel (Ni), manganese (Mn), aluminum (Al), antimony (Sb), beryllium (Be), rhenium (Re), gallium (Ga), titanium (Ti), zirconium (Zr), hafnium (Hf), and tin (Sn). However, occasionally, a luminous intensity of the lamp including the secondary metal halides rises slowly, because a film formed on the inner surface of the discharge vessel diffuses visible light.

The interspace (L) between the tips of electrodes is preferable to about 6 mm or less. When the distance (L) is over about 6 mm, it is difficult to position the entire distance (L) at the focus of a reflector. Therefore, visible light can not appropriately reflect on the inner surface of the reflector, and brightness may reduce.

Dimensions of the discharge vessel 1 and compositions of the ionizable gas filling will be described below in Example 1.

EXAMPLE 1

| Dimensions of discharge vessel | |
|---|---|
| Outer diameter at center | About 6.5 mm |
| Maximum inner diameter (D) | About 4.5 mm |
| Interspace between tips (L) | About 4.2 mm |
| Diameter of electrode rod | About 0.4 mm |
| Length of electrode rod | About 7 mm |
| Maximum diameter of electrode | About 0.6 mm |
| D/L ratio | About 1.07 |
| t/L ratio | About 0.24 |
| Compositions of ionizable gas filling | |
| Scandium iodide ($ScI_3$) as metal halid | About 0.5 mg |
| Sodium iodide (NaI) as metal halid | About 3.5 mg |
| Zinc iodide ($ZnI_2$) as secondary metal halide | About 0.6 mg |
| Xenon (Xe) gas as rare gas | About 5 atm |

Figure 4:
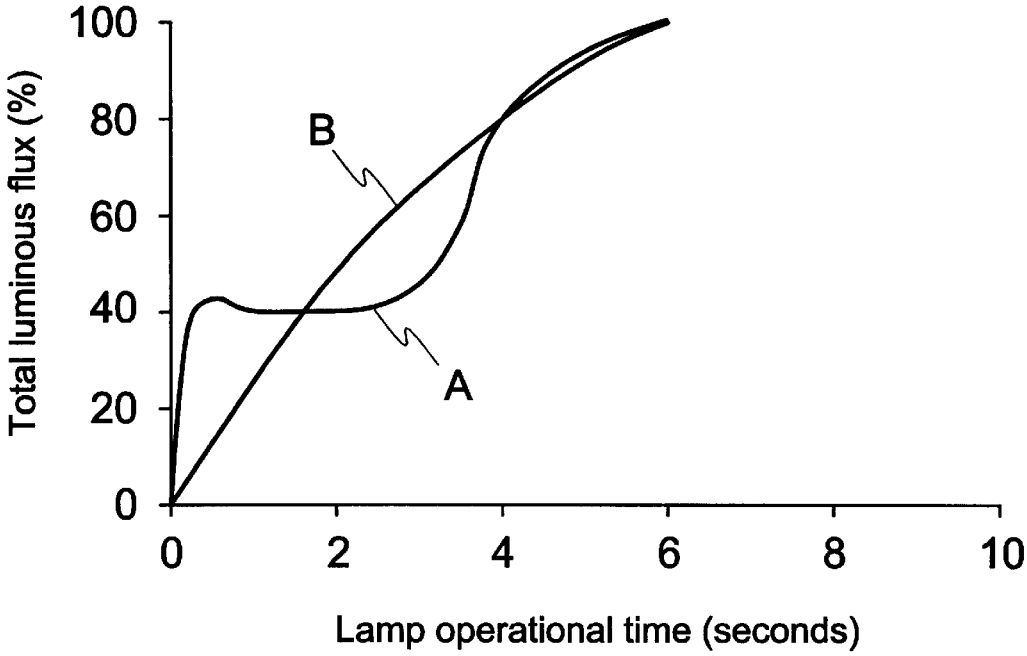
FIG. 4 is a graph showing a total luminous flux as a function of lamp operational time.

FIG. 4 is a graph of total luminous flux as a function of lamp operational time. The horizontal axis indicates lamp operational time beginning when the lamp is turned ON. The vertical axis indicates a correlated total luminous flux. Line A designates the total luminous flux of Example 1. Line B designates that of a Test Sample, which is constructed the same in Example 1 except for being filled with mercury (Hg) instead of zinc iodide ($ZnI_2$). Example 1 (line A) exhibits a rapid increase the total luminous flux within one second after the lamp started.

Figure 5:
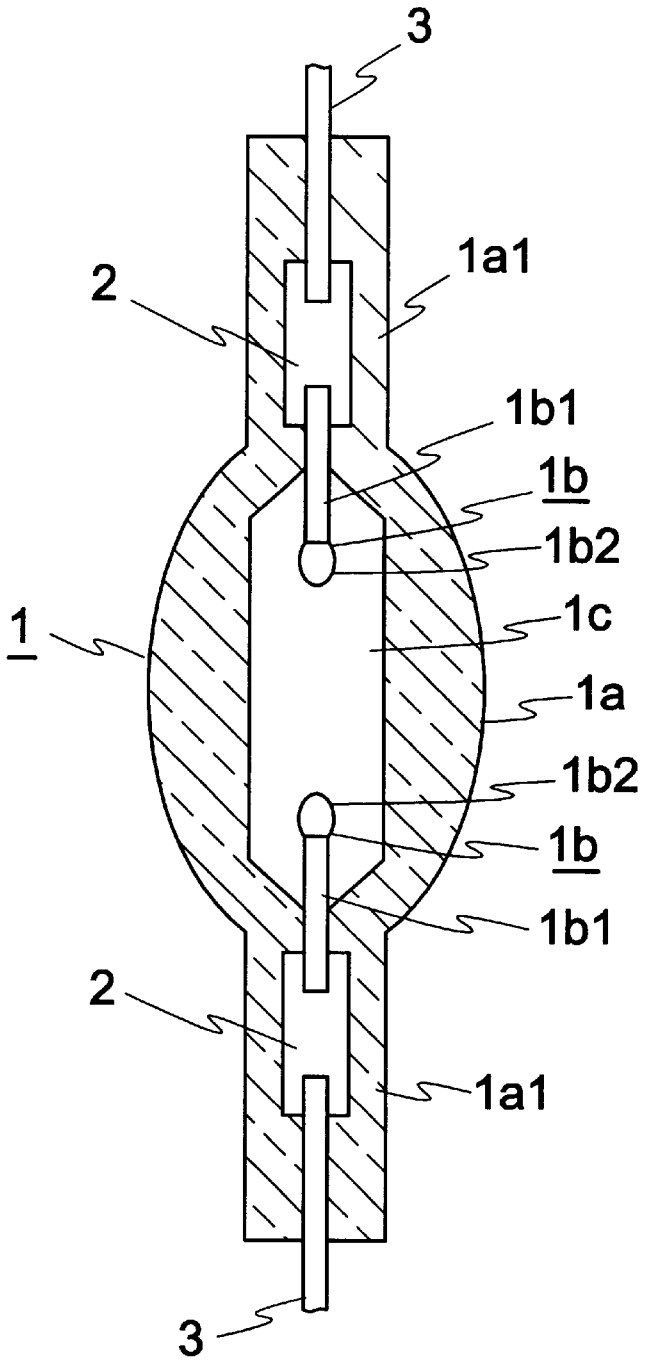
FIG. 5 is a longitudinal section of a metal halide lamp according to a second embodiment of the present invention.
Figure 6:
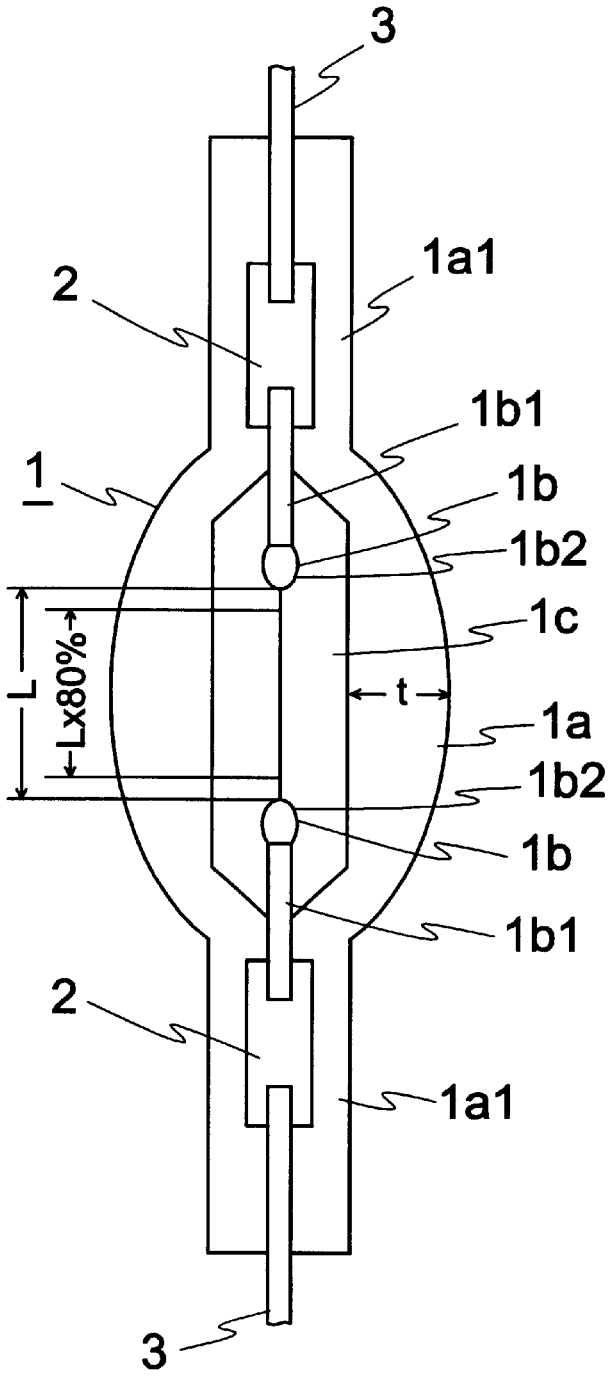
FIG. 6 is a side view of the metal halide lamp shown in FIG. 5.

A second exemplary embodiment of the invention will be explained in detail referring to FIGS. 5 to 7. The same reference numerals refer to like or similar parts to those already described and therefore detailed explanation of those parts will not be provided. In this embodiment, a discharge space 1*c* of a discharge vessel 1 is formed into a near cylindrical shape as shown in FIGS. 5 and 6. Therefore, an arc discharge occurs along the cylindrical shape.

Dimensions of the discharge vessel 1 and compositions of the ionizable gas filling will be described below in Example 2.

EXAMPLE 2

| Dimensions of discharge vessel | |
|---|---|
| Outer diameter at center | About 6.5 mm |
| Maximum inner diameter | About 3 mm |
| Interspace between tips | About 4.2 mm |
| Diameter of electrode rod | About 0.4 mm |
| Length of electrode rod | About 7 mm |
| Maximum diameter of electrode | About 0.6 mm |
| D/L ratio | About 0.71 |
| t/L ratio | About 0.42 |
| Compositions of ionizable gas filling | |
| Scandium iodide ($ScI_3$) as metal halid | About 0.5 mg |
| Sodium iodide (NaI) as metal halid | About 3.5 mg |
| Zinc iodide ($ZnI_2$) as secondary metal halide | About 0.6 mg |
| Xenon (Xe) gas as rare gas | About 5 atm |

Figure 7:
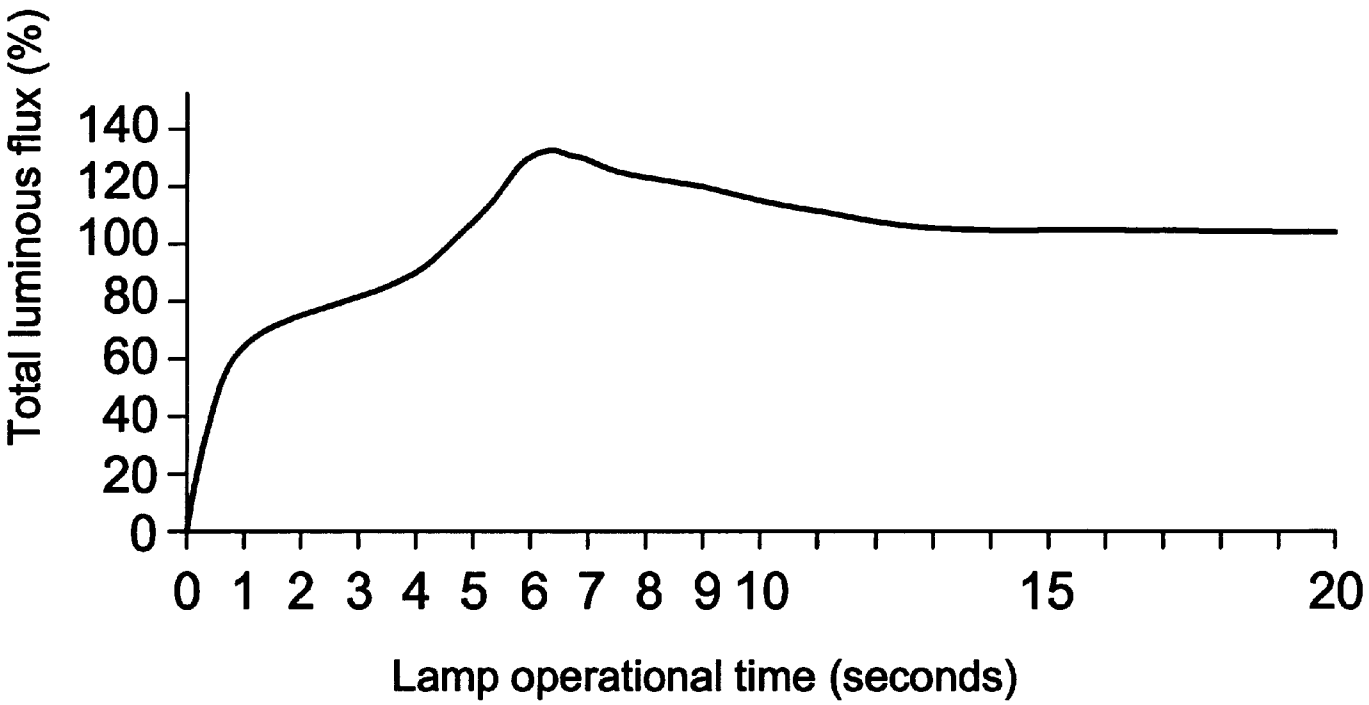
FIG. 7 is a graph showing a total luminous flux as a progress of lamp operational time.

The arrangement of example 2 also provides a quick increase in the total luminous flux within about one second after the lamp started, as plotted in FIG. 7.

Figure 8:
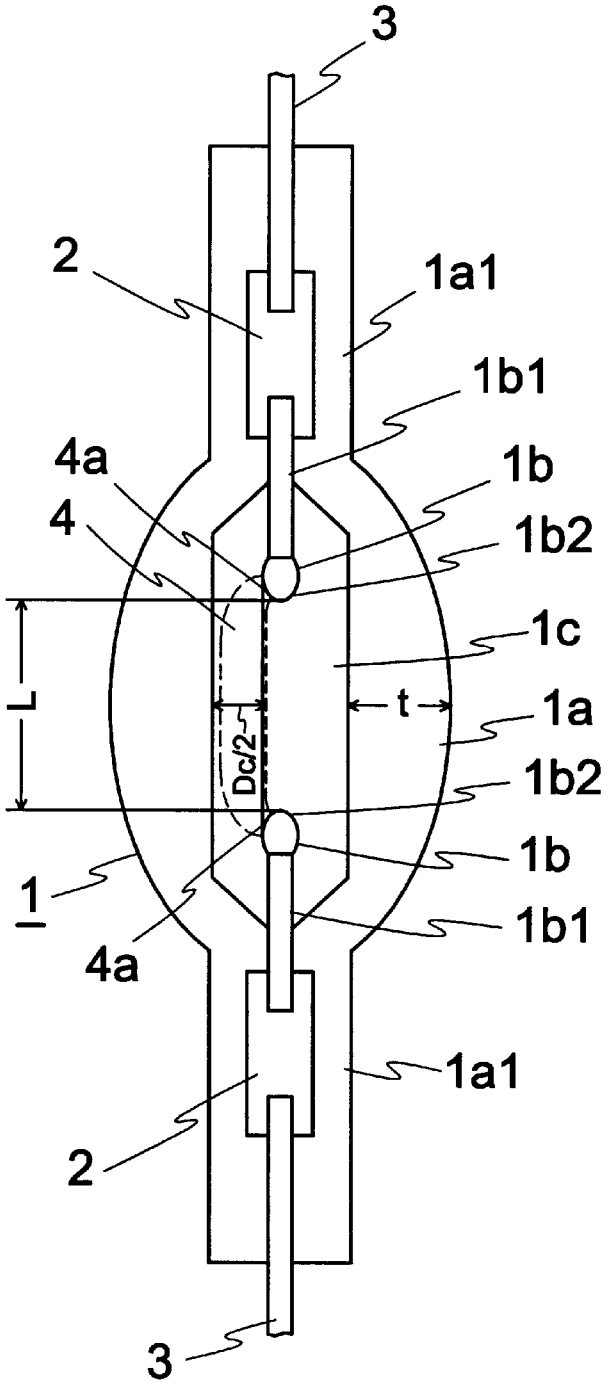
FIG. 8 is a side view of a metal halide lamp according to a third embodiment of the present invention.

A third exemplary embodiment of the invention will be explained in detail referring to FIG. 8, which shows a side view of a metal halide lamp. The same reference numerals refer to like or similar parts to those already described in FIG. 6 and therefore detailed explanation of those parts will not be provided. In this embodiment, starting points of the discharge arc on both electrode tips will be located on one side of the axis of the electrodes.

An arc discharge 4, which occurs between discharge starting points 4*a* at tips 1*b*2 of electrodes 1*b*, is adjacent to the inner wall of the discharge vessel 1. Generally, when the metal halide lamp arranged horizontally is started, the arc discharge 4 tends to curve upward into the discharge space 1*c*. Accordingly, the discharge starting points 4*a* transfer to upward of the tips 1*b*2 of the electrodes 1*b*. A distance between the transferred arc discharge and the inner surface is defined as Dc/2. As a result, it is seen that the inner diameter (Dc) of the discharge vessel is made shorter. The amended inner diameter of the discharge vessel is a length of Dc. Because L and t were explained already, further explanation is not provided. When the tips 1*b*2 of the electrodes 1*b* are made larger, the arc discharge transforms conspicuously. In this case, the Dc/L ratio is in the range of about 0.25 to about 0.96, and the t/L ratio is within a range of about 0.16 to about 1.1. It is more preferable that the Dc/L ratio has a range of about 0.45 to about 0.9, and the t/L ratio has within about 0.31 to about 0.57.

Figure 9:
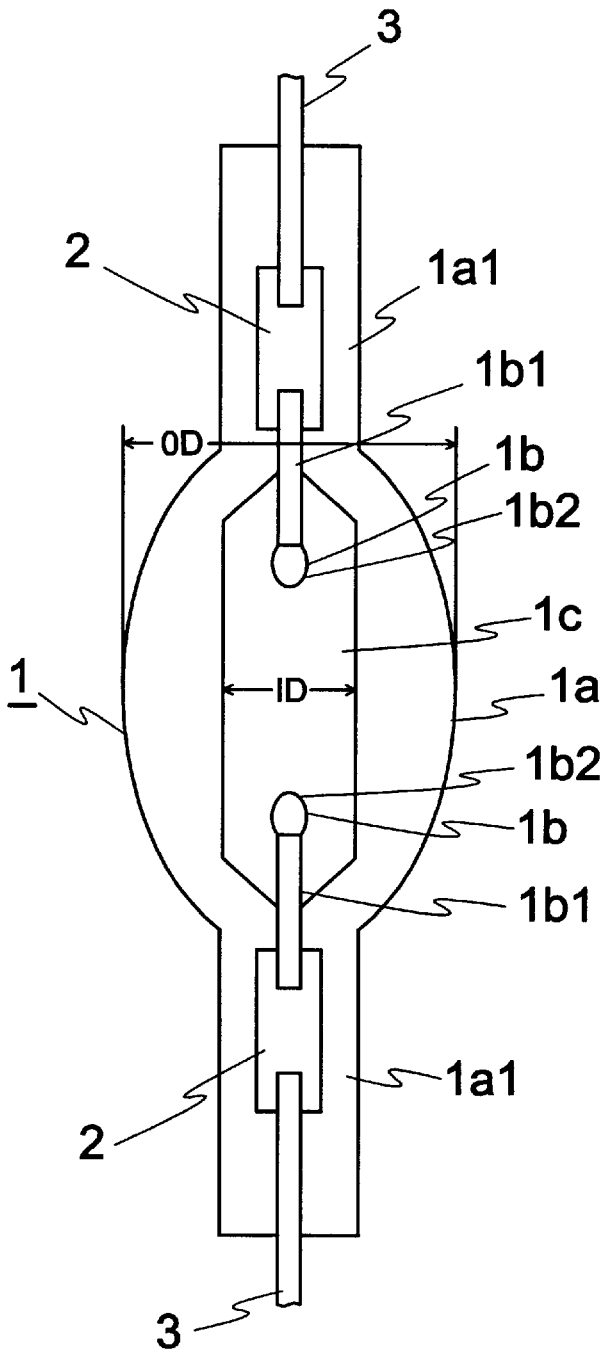
FIG. 9 is a side view of a metal halide lamp according to a fourth embodiment of the present invention.

A fourth exemplary embodiment of the invention will be explained in detail referring to FIG. 9, which shows a side view of a metal halide lamp. In this embodiment, a discharge space 1*c* is narrowly formed in order to prevent a discharge vessel 1 from expanding. A lamp power P (W) is 100 W or less. A relation of both an inner diameter ID (mm) and an outer diameter OD (mm) of the discharge vessel 1 and the lamp power (P) is expressed by the following formula:

$$(OD-ID)*ID/P>0.21.$$

The discharge vessel 1 is filled with an ionizable gas filling, which contains a metal halide and a rare gas. The metal halide includes at least sodium (Na) and scandium (Sc). The rare gas includes at least xenon (Xe). When the metal halide lamp, arranged horizontal, lights up, an arc discharge tends to curve to upward in the discharge space 1*c*.

When the lamp is used as a vehicle lighting apparatus, it is preferable that the arc discharge does not curve in the upward direction. Japanese Laid Open SHO 59-111244 discloses a technique for reducing a curve of an arc discharge by forming the discharge space into small size. In this case, the arc discharge comes near to the inner surface of a discharge vessel, so that a heat of the arc discharge conducts to the discharge vessel too much. Accordingly, the discharge vessel occasionally expands due to the heat. However, the shape of the discharge vessel formed according to the above formula is useful in order to avoid problems due to expansion of the discharge vessel.

The metal halide lamp of this embodiment may further comprise the above-mentioned secondary metal halide. That is, the metal halide includes sodium (Na), scandium (Sc), and the secondary metal halide. Besides, xenon (Xe) as the rare gas filling pressure A (atm) at 25 degrees centigrade and the interspace L (mm) is satisfied by a following formula: $1.04 \leqq A/L \leqq 4$. According to the formula, a lamp current and a start voltage can be appropriately set up. The A/L ratio is more preferable in a range of about 1.4 to about 2.78. If the A/L ratio is under about 1.04, the lamp current tends to increase too much, so that mass of the ballast becomes large. When the A/L ratio is over about 2.78, the filling pressure A of xenon (Xe) rises highly, so that a starting property becomes slightly bad because of a start voltage rising.

Dimensions of the discharge vessel 1 and compositions of the ionizable gas filling will be described below in Examples 3 to 4.

EXAMPLE 3

The shape of the discharge vessel is the same as the first embodiment in FIG. 1.

| Dimensions of discharge vessel | |
|---|---|
| Outer diameter at center (OD) | About 6.5 mm |
| Maximum inner diameter (ID) | About 4.5 mm |
| Interspace between tips | About 4.2 mm |
| Diameter of electrode rod | About 0.4 mm |

-continued

| | |
|---|---|
| Length of electrode rod | About 7 mm |
| Maximum diameter of electrode | About 0.6 mm |
| Compositions of ionizable gas filling | |
| Scandium iodide ($ScI_3$) as metal halid | About 0.5 mg |
| Sodium iodide (NaI) as metal halid | About 3.5 mg |
| Zinc iodide ($ZnI_2$) as secondary metal halide | About 0.6 mg |
| Xenon (Xe) gas as rare gas | About 8 atm |
| A/L ratio | About 1.9 |

EXAMPLE 4

The shape is the same as the second embodiment in FIG. 6. The discharge space is formed into a cylindrical shape. Compositions of the ionizable gas filling is the same in Example 3.

| Dimensions of discharge vessel | |
|---|---|
| Outer diameter at center (OD) | About 6.5 mm |
| Maximum inner diameter (ID) | About 3 mm |
| Interspace between tips | About 4.2 mm |
| Diameter of electrode rod | About 0.4 mm |
| Length of electrode rod | About 7 mm |
| Maximum diameter of electrode | About 0.6 mm |

A fifth exemplary embodiment of the invention will be explained in detail referring to FIG. 10, which shows a side view of a metal halide lamp. In this embodiment, A lamp power (P) is 100W or less. Discharge vessel 1 is filled with an ionizable gas filling, which contains a metal halide, a secondary metal halide and a rare gas. A metal halide includes at least sodium (Na) and scandium (Sc). Reference L is the above-mentioned distance between tips 1*b*2 of electrodes 1*b*.

Figure 10:
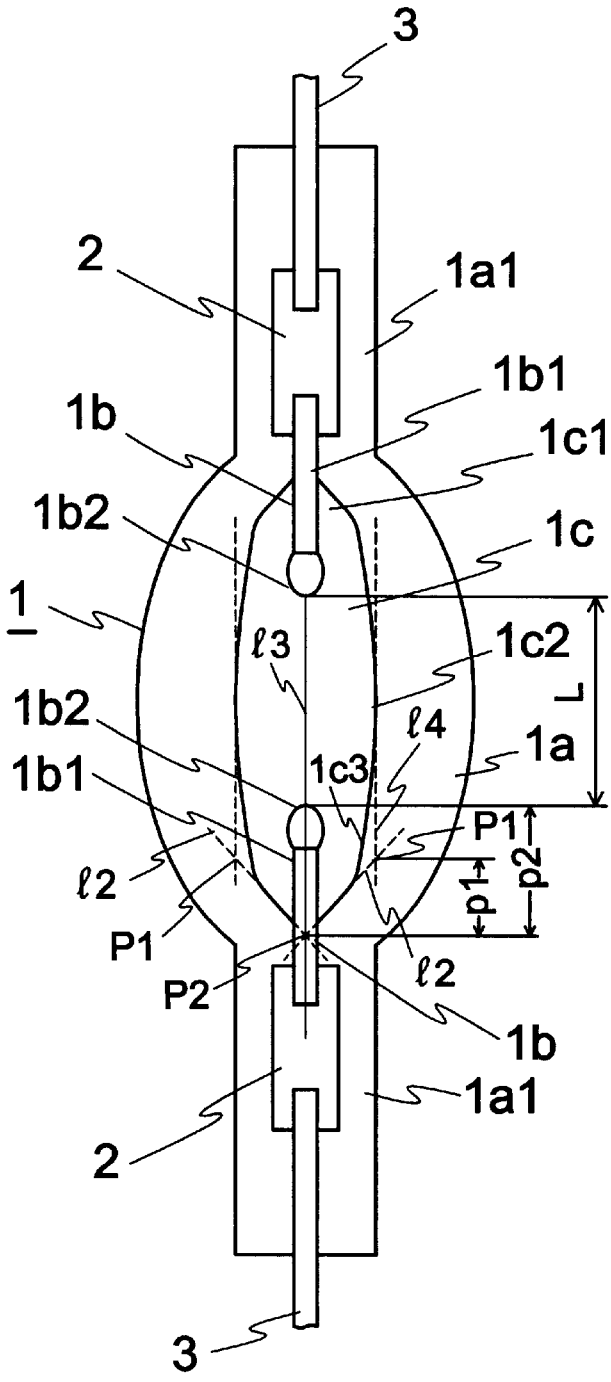
FIG. 10 is a side view of a metal halide lamp according to a fifth embodiment of the present invention.

The inner surface of a discharge space 1*c* shown in FIG. 10, is formed into an approximately elliptic shape. Furthermore, both sides of the inner surface are formed into a conic shape. An extending line (12) from a cone and a tangential line (14) of the center of the ellipse cross each other at a point P1. The extending lines (12) in opposite direction of the point P1 intersect at a point P2. A length p1 is a distance from the point P1 to P2. A reference p2 is a length projecting into a discharge space 1*c*, or a distance between the point P2 and a tip 1*b*2 of an electrode 1*b*. The length p1 and p2 relate to a following formula:

$$0.6 \leqq p2/p1 \leqq 1.7.$$

Each of electrodes 1*b*, whose one end is embedded in sealed portions 1*a*1 through the apex of the cone, is located on a longitudinal axis (13). The p2/p1 ratio may be in a range of about 1.0 to about 1.3.

When the p2/p1 ratio is under about 0.6 and dimensions of the discharge space 1*c* are constant, the point P2 tends to shorten and the interspace (L) between the tips 1*b*2 of the electrodes 1*b* becomes long. Therefore, a temperature of the discharge vessel 1 around the electrodes 1*b* increases too much, so that the discharge vessel 1 may expand occasionally.

When the interspace (L) is constant instead of the dimensions of the discharge space 1, the discharge space 1*c* becomes small. In this case, the distance between the electrodes 1*b* and the inner surface of the discharge vessel 1 becomes short, so that the temperature of the discharge vessel 1 increases sharply. Accordingly, the discharge vessel 1 may expand occasionally.

If the p2/p1 ratio is over 1.7 and the dimensions of the discharge space 1*c* are constant, the interspace (L) becomes short. When the interspace (L) is constant instead of the dimensions of the discharge space 1*c*, the discharge space becomes large. In this case, a distance between the electrodes 1*b* and the inner surface of the discharge vessel 1 becomes long, so that the temperature of around the length p1 of the discharge vessel 1 increases slowly. As a result, luminous flux also increases slowly.

Dimensions of the discharge vessel 1 and compositions of the ionizable gas filling will be described below in Examples 5 to 6.

EXAMPLE 5

The shape of the discharge vessel is the same as the first embodiment in FIG. 1.

| Dimensions of discharge vessel | |
|---|---|
| Outer diameter at center | About 6.5 mm |
| Maximum inner diameter | About 4.5 mm |
| Interspace between tips | About 4.2 mm |
| Diameter of electrode rod | About 0.4 mm |
| Length of electrode rod | About 7 mm |
| Maximum diameter of electrode | About 0.6 mm |
| p2/p1 | About 1 |
| Compositions of ionizable gas filling | |
| Scandium iodide ($ScI_3$) as metal halid | About 0.5 mg |
| Sodium iodide (NaI) as metal halid | About 3.5 mg |
| Zinc iodide ($ZnI_2$) as secondary metal halide | About 0.6 mg |
| Xenon (Xe) gas as rare gas | About 5 atm |

EXAMPLE 6

The shape of the discharge vessel 1 is the same as the first embodiment in FIG. 1. Compositions of the ionizable gas filling is the same in Example 5.

| Dimensions of discharge vessel | |
|---|---|
| Outer diameter at center | About 6.5 mm |
| Maximum inner diameter | About 3 mm |
| Interspace between tips | About 4.2 mm |
| Diameter of electrode rod | About 0.4 mm |
| Length of electrode rod | About 7 mm |
| Maximum diameter of electrode | About 0.6 mm |
| p2/p1 ratio | About 1.3 |

Figure 11:
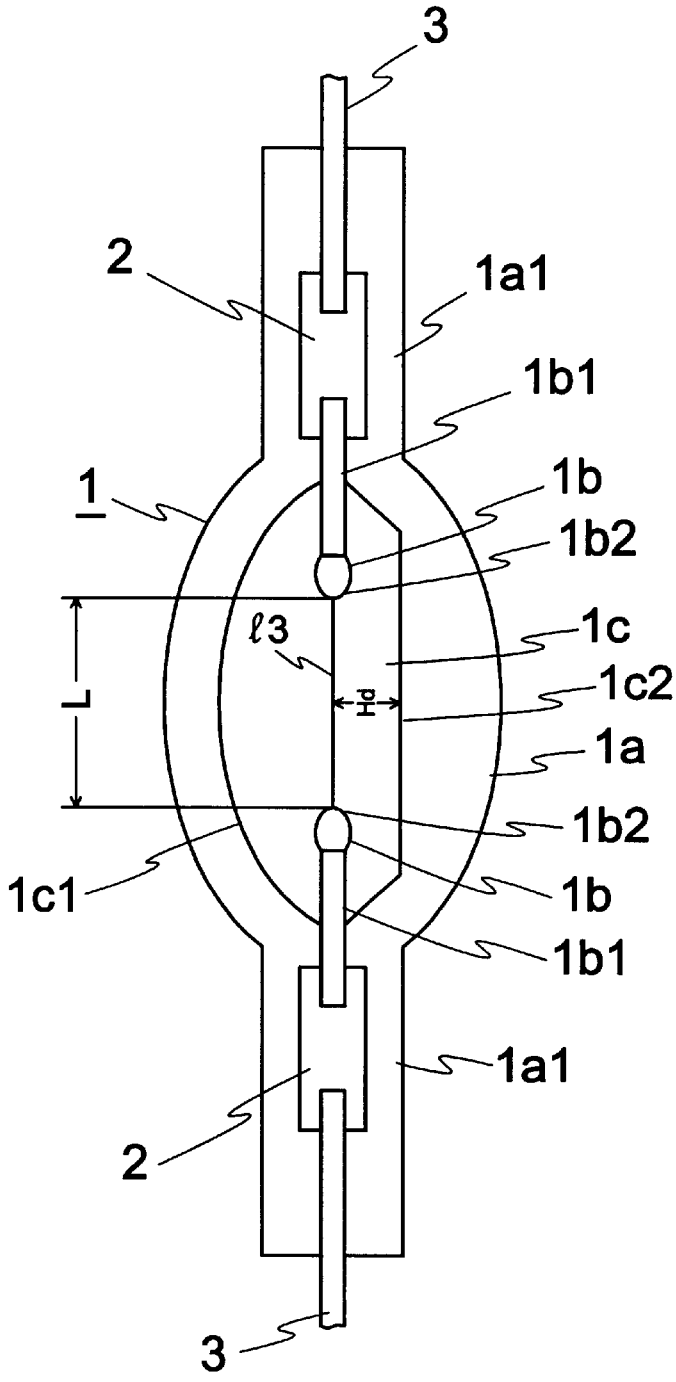
FIG. 11 is a side view of a metal halide lamp according to a sixth embodiment of the present invention.

A sixth exemplary embodiment of the invention will be explained in detail referring to FIG. 11, which shows a side view of a metal halide lamp. In this embodiment, an upper and a lower shapes of the inner surface of a discharge vessel 1 are not symmetrically formed with respect to the axis (13) of electrodes 1*b*. That is, a distance between the axis (13) and an upper inner surface 1*c*1 is longer than that between the axis (13) and lower inner surface 1*c*2. The ratio Hd/L is in a range of about 0.15 to about 0.5, wherein Hd is a distance between the axis (13) and the lower inner surface 1*c*2, L is a distance between tips 1*b*2 of electrodes 1*b*. The Hd/L ratio is preferably in a range of about 0.22 to about 0.45.

An arc discharge generating in the discharge vessel 1 makes a temperature of the discharge vessel 1 increase, because the center of the arc discharge 1 is adjacent to the lower inner surface 1*c*2. Accordingly, a heat conduction from the arc discharge to the lower side of the discharge vessel 1 increases, so that a temperature of the discharge vessel 1 rises appropriately. The heat promotes an evaporation of a liquid halide adhering on the lower inner surface 1*c*2, so that a luminous flux increases quickly. When the Hd/L ratio is less than about 0.15, the heat conduction becomes too much, so that the discharge vessel 1 may occasionally expand. Furthermore, if the Hd/L ratio is larger than about 0.5, it is difficult to increase the temperature of the discharge vessel 1.

Dimensions of the discharge vessel 1 and compositions of the ionizable gas filling will be described below in Example 7.

EXAMPLE 7

| Dimensions of discharge vessel | |
|---|---|
| Outer diameter at center | About 6.5 mm |
| Maximum inner diameter | About 4.5 mm |
| Interspace between tips | About 4.2 mm |
| Diameter of electrode rod | About 0.4 mm |
| Length of electrode rod | About 7 mm |
| Maximum diameter of electrode | About 0.6 mm |
| Hd | About 1.5 mm |
| Hd/L ratio | About 0.36 |
| Compositions of ionizable gas filling | |
| Scandium iodide ($ScI_3$) as metal halid | About 0.2 mg |
| Sodium iodide (NaI) as metal halid | About 1 mg |
| Zinc iodide ($ZnI_2$) as secondary metal halide | About 0.6 mg |
| Xenon (Xe) gas as rare gas | About 5 atm |

Figure 12:
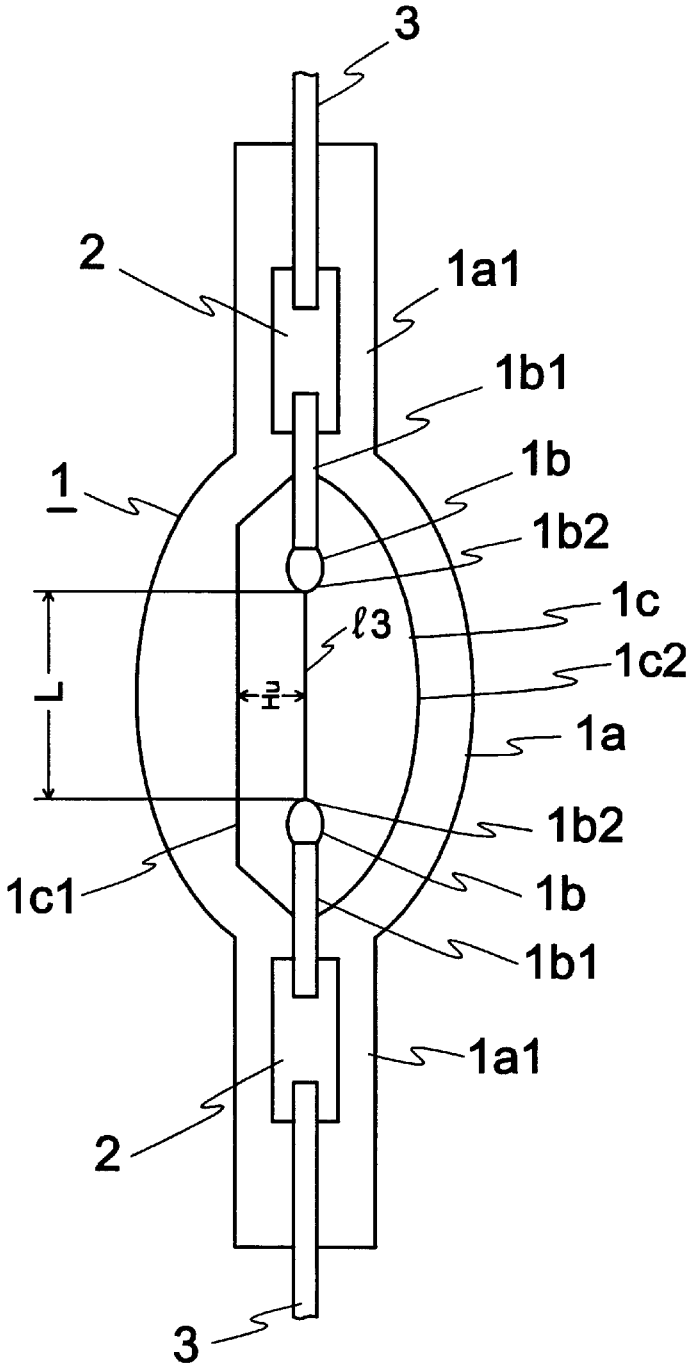
FIG. 12 is a side view of a metal halide lamp according to a seventh embodiment of the present invention.

A seventh exemplary embodiment of the invention will be explained in detail referring to FIG. 12, which shows a side view of a metal halide lamp. In this embodiment, an upper and a lower shape of the inner surface of a discharge vessel 1 are not symmetrically formed with respect to the axis (13) of electrodes 1*b*. That is, a distance between the axis (13) and an upper inner surface 1*c*1 is shorter than that of between the axis (13) and a lower inner surface 1*c*2. The ratio Hu/L is in a range of about 0.15 to about 0.5, wherein Hu is a distance between the axis (13) and the upper inner surface 1*c*1, L is a distance between tips 1*b*2 of electrodes 1*b*. The Hu/L ratio is preferably in a range of about 0.22 to about 0.45.

An arc discharge generated in the discharge vessel 1 causes the temperature of the discharge vessel 1 to increase because the center of the arc discharge is adjacent to the upper inner surface 1*c*1. Accordingly, heat conduction from the arc discharge to the discharge vessel 1 increases, so that the temperature of the discharge vessel 1 rises. The heat promotes evaporation of liquid halide adhering on the lower inner surface 1*c*2, so that luminous flux increases quickly. When the Hu/L ratio is less than about 0.15, heat conduction is too high, and the discharge vessel 1 may occasionally expand. Furthermore, if the Hu/L ratio is larger than about 0.5, it is difficult to increase the temperature of the discharge vessel 1.

Dimensions of the discharge vessel 1 and compositions of the ionizable gas filling will be described below in Example 8.

EXAMPLE 8

| Dimensions of discharge vessel | |
|---|---|
| Outer diameter at center | About 6.5 mm |
| Maximum inner diameter | About 4.5 mm |
| Interspace between tips | About 4.2 mm |
| Diameter of electrode rod | About 0.4 mm |
| Length of electrode rod | About 7 mm |
| Maximum diameter of electrode | About 0.6 mm |
| Hu | About 1.5 |
| Hd/L | About 0.36 |
| Compositions of ionizable gas filling | |
| Scandium iodide ($ScI_3$) as metal halid | About 0.2 mg |
| Sodium iodide (NaI) as metal halid | About 1 mg |
| Zinc iodide ($ZnI_2$) as secondary metal halide | About 0.6 mg |
| Xenon (Xe) gas as rare gas | About 5 atm |

EXAMPLE 9-A2

Dimensions of the discharge vessel are the same in Example 9-A1.

| Compositions of ionizable gas filling | |
|---|---|
| Scandium iodide ($ScI_3$) as metal halide | About 0.2 mg, |
| Sodium iodide (NaI) as metal halide | About 0.6 mg |
| Xenon (Xe) gas as rare gas | About 8 atm |

Test Sample 9-B

Dimensions of the discharge vessel are the same in Example 9-A1.

| Compositions of ionizable gas filling | |
|---|---|
| Scandium iodide ($ScI_3$) as metal halide | About 0.2 mg |
| Sodium iodide (NaI) as metal halide | About 0.6 mg |
| Xenon (Xe) gas as rare gas | About 8 atm |
| Mercury (Hg) | About 1 mg |

Table 1 describes respectively a lamp voltage, a total luminous flux, a general color rendering index (Ra), and a color temperature. Each lamp in Table 1 has a lamp power of 40 W using a ballast generating a frequency of 200 Hz. This embodiment is suitable for use as a vehicle lighting apparatus because produces the needed total luminous flux within the prescribed time.

Figure 13:
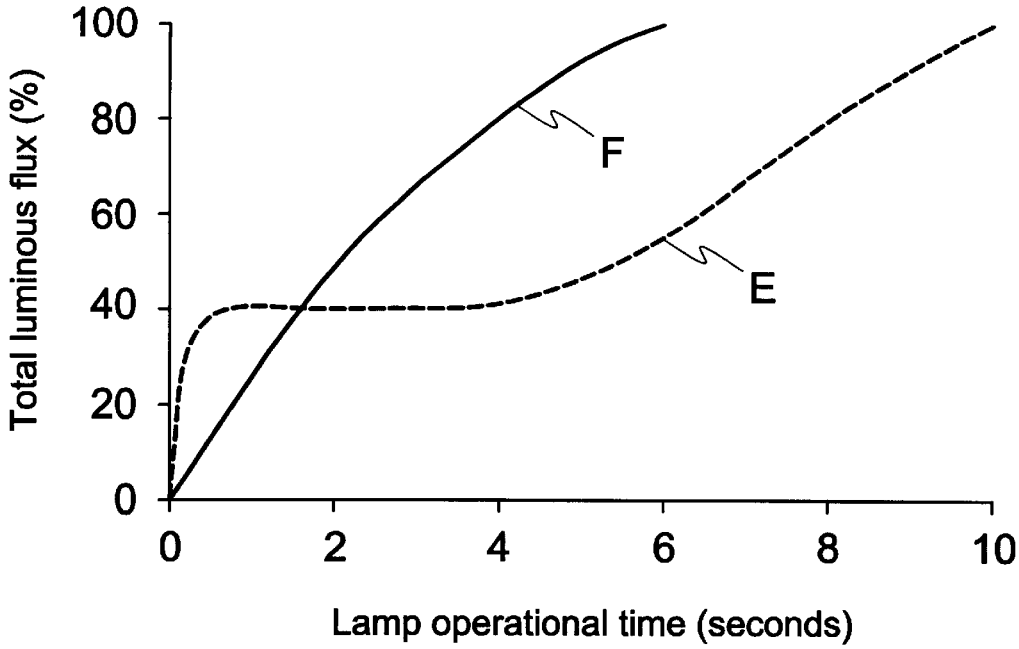
FIG. 13 is a graph showing a total luminous flux as a progress of lamp operational time.

FIG. 13 is a graph showing a total luminous flux as a progress of lamp operational time. The horizontal axis indicates lamp operational time in seconds from the initial application of power. The vertical axis indicates a correlated total luminous flux. Lines E and F designate the total luminous flux of Example 9-A1 and Test Sample 9-B, respectively.

Example 9-A1 can quickly increase the total luminous flux within one second after the lamp started. The total luminous flux of Example 9-A2 also is the same as Example 9-A1.

TABLE 1

| Lamps | Example 9-A1 | Example 9-A2 | Test Sample 9-B |
|---|---|---|---|
| (1) Lamp voltage (V) | 35 | 33 | 80 |
| (2) Total luminous flux (lm) | 3400 | 3450 | 3600 |
| (3) General color rendering index (Ra) | 71 | 68 | 63 |
| (4) Color temperature (K) | 4320 | 4040 | 4240 |

The above (3) general color rendering index (Ra) and (4) color temperature (K) are as follows, when a lamp power is changed in the range of about 15 W to about 40 W.

TABLE 2

| Lamp | Example 9-A1 | | Example 9-A2 | | Test Sample 9B | |
|---|---|---|---|---|---|---|
| power | (3)(Ra) | (4)(K) | (3)(Ra) | (4)(K) | (3)(Ra) | (4)(K) |
| 15 W | 60 | 4580 | 60 | 4280 | 40 | 5660 |
| 20 W | 65 | 4520 | 62 | 4220 | 45 | 5370 |
| 25 W | 66 | 4450 | 63 | 4150 | 52 | 5130 |
| 30 W | 67 | 4390 | 64 | 4120 | 56 | 4660 |
| 35 W | 69 | 4350 | 66 | 4080 | 61 | 4430 |
| 40 W | 71 | 4320 | 68 | 4040 | 63 | 4240 |

According to Examples 9-A1 and 9-A2 in Table 2, both the general color rendering index (Ra) and the color temperature (K) do not change too much, even if the lamp power is outside the range of about 15 W to about 40 W. However, Test sample 9-B cannot be prevented from decreasing the above (3) general color rendering index (Ra) and (4) color temperature (K).

In this case, a test was carried out as follows: after each of the lamps was operated at a lamp power of 30 W for 30 minutes, each lamp was turned OFF. Ten seconds later, each lamp was turned on at a re-starting voltage again. The re-starting voltage is indicated in Table 3.

TABLE 3

| | Example 9-A1 | Example 9-A2 | Test Sample 9-B |
|---|---|---|---|
| Re-starting voltage (KV) | 8.8 | 9.2 | 16.3 |

According to Table 3, Examples 9-A1 and 9-A2 are able to re-start easily at a low re-starting voltage in comparison with Test Sample 9-B having mercury (Hg). However, when the lamp of Test Sample 9-B re-starts, mercury (Hg) still evaporates in the discharge vessel at high pressure. Therefore, the re-starting voltage of the lamp tends to become higher, so that the lamp can not easily light up by the supplied voltage.

Figure 14:
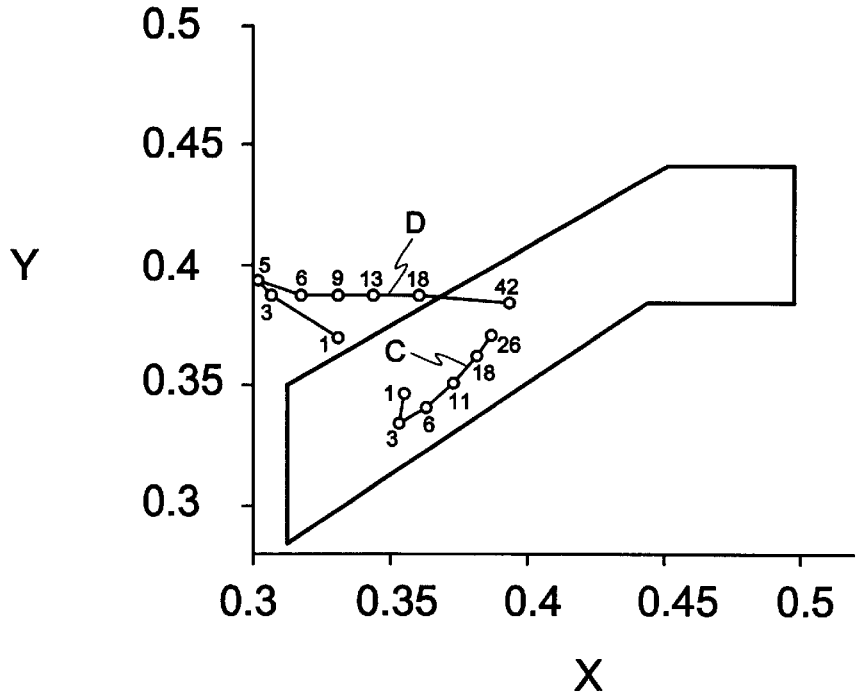
FIG. 14 is a chromaticity diagram of a vehicle lighting apparatus according to an eighth embodiment of the present invention.

FIG. 14 is a chromaticity diagram of a vehicle lighting apparatus using lamps of Examples 9-A1 and Test Sample 9-B. The vehicle lighting apparatus is supplied with a lamp power of 80 W at the beginning of a lamp starting. After the lamp turned on, the lamp power is gradually reduced by a power controlling means (not shown), so that the lamp power is regulated at 40 W. A chromaticity of the specific point of the vehicle lighting apparatus is plotted on a chromaticity diagram, while changing the lamp power from 80 W to 40 W. The result of Example 9-A1 and Test sample 9-B is shown in FIG. 14.

In FIG. 14, the horizontal and vertical axes respectively indicate X and Y chromaticity coordinates. A region surrounded by a frame line designates a white color part relating to the vehicle lighting apparatus, which is regulated by Japanese Industrial Standard (JIS). Line C and D respectively point out the chromaticities of Example 9-A1 and Test sample 9-B. Numbers around the line C or D stand for operational progress time (seconds) after the lamp started. According to FIG. 14, the chromaticity of Example 9-A1 is appropriate to the vehicle lighting apparatus regulation at the beginning of the lamp starting because of sodium (Na), scandium (Sc), and xenon (Xe) illuminating in the discharge vessel. However, the chromaticity of Test Sample 9-B becomes out-of-regulation of JIS at the beginning of the lamp starting because of mercury (Hg) illuminating in the discharge vessel. It takes about twenty three seconds for the chromaticity to become within the range specified by the regulation.

The reports of additional testing follow. Each of lamps of Example 9-A1 and Test Sample 9-B was started at three different power levels, namely, 80 W, 90 W, and 100 W. After one and four seconds, total luminous flux of each lamp was measured at each lamp power. The luminous fluxes of both Example 9-A1 and Test Sample 9-B were respectively compared with those of the lamps which constantly light up at 40 W. Results are presented in Table 4.

TABLE 4

| | Total luminous flux (%) | | | |
|---|---|---|---|---|
| | One second later | | Four seconds later | |
| Lamp power of starting | Example 9-A1 | Test Sample 9-B | Example 9-A1 | Test Sample 9-B |
| 80 W | 32 | 25 | 70 | 78 |
| 90 W | 42 | 28 | 75 | 120 |
| 100 W | 51 | 35 | 82 | 180 |

According to Example 9-A1 in Table 4, after the lamp turned on, one second later, xenon (Xe), scandium (Sc), sodium (Na), and dysprosium (Dy) illuminate in one second. In Test Sample 9-B, both xenon (Xe) and mercury (Hg) illuminate at low efficiency, so that the total luminous flux of Test Sample 9-B decreases. However, four seconds later, the luminous flux of Test sample 9-B increases, because mercury (Hg) evaporates sufficiently. In Test Sample 9-B, when the lamp is supplied 100 W of lamp power, the total luminous flux, i.e., 180% is out-of-regulation of JIS.

A ninth exemplary embodiment of this invention will be explained below. In this embodiment, the discharge-vessel shape is the same as that of the second embodiment in FIG. 5. Xenon (Xe) gas fills in a discharge vessel at 8 atm pressure. A metal halide in Table 5 filling the discharge vessel is different from that of the second embodiment.

TABLE 5

| Metal halide of filling | Example 10-C1 | Example 10-C2 | Example 10-C3 | Example 10-C4 |
|---|---|---|---|---|
| Scandium iodide ($ScI_3$) | 0.2 mg | 0.2 mg | 0.2 mg | 0.2 mg |
| Sodium iodide (NaI) | 1 mg | 1 mg | 1 mg | 1 mg |
| Thulium iodide ($TmI_3$) | 0.05 mg | — | — | — |
| Neodymium iodide ($NdI_3$) | — | 0.05 mg | — | — |
| Cerium iodide ($CeI_3$) | — | — | 0.05 mg | — |
| Holmium iodide ($HoI_3$) | — | — | — | 0.05 mg |

Followings in Table 6 are lamp voltage, total luminous flux, general color rendering index (Ra), and color temperature, wherein the lamps (Example 10-C1 to C5) consumes 40 W of lamp power during lamp operation using a ballast generating frequency of 200 Hz. This embodiment is suitable for use as a vehicle lighting apparatus because it satisfies the total luminous flux requirements.

TABLE 6

| Lamp | Example 10-C1 | Example 10-C2 | Example 10-C3 | Example 10-C4 |
|---|---|---|---|---|
| (1) Lamp voltage (V) | 34 | 33 | 32 | 32 |
| (2) Total luminous flux (lm) | 3420 | 3340 | 3480 | 3350 |
| (3) General color rendering index (Ra) | 69 | 71 | 69 | 72 |
| (4) Color temperature (K) | 4410 | 4370 | 4450 | 4340 |

A tenth exemplary embodiment of the invention will now be explained. In this embodiment, a relation between a filling pressure X (atm) of xenon (Xe) and a maximum electrical power AA (W) is provided with a following formula:

$$3<X<15,\ AA\geqq-2.5X+102.5,$$

in order to achieve a luminous intensity of 8000 cd at a representative point of a front surface of a vehicle light apparatus in four seconds, after the lamp lit up, wherein the maximum electrical power AA (W) is a maximum wattage supplied to the lamp in four seconds, after the lamp lit up.

The maximum electrical power AA (W) is in proportion to the filling pressure X (atm), because xenon (Xe) almost emits light four seconds later in comparison with metal halide having low vapor pressure. Besides, a luminous flux of xenon (Xe) is originally in proportion to both the filling pressure X (atm) and the electrical power AA (W), so that it is easily to adjust the luminous flux. Examples 11-1 to 11-7 are described as follows.

EXAMPLE 11-1

The shape of a discharge vessel is the same as that of the second embodiment in FIG. 6. The discharge space is nearly a cylindrical shape.

| Dimensions of discharge vessel | |
|---|---|
| Outer diameter at center | About 6.5 mm |
| Maximum inner diameter | About 3 mm |
| Interspace between tips | About 4.2 mm |
| Diameter of electrode rod | About 0.4 mm |
| Length of electrode rod | About 7 mm |
| Maximum diameter of electrode | About 0.7 mm |
| Compositions of ionizable gas filling | |
| Scandium iodide ($ScI_3$) as metal halide | About 0.2 mg |
| Sodium iodide (NaI) as metal halide | About 1 mg |
| Dysprosium iodide ($DyI_3$) as metal halide | About 0.05 mg |
| Xenon (Xe) gas as rare gas | About 3 atm |

EXAMPLE 11-2 TO 11-7

Each of dimensions of discharge vessels in Examples 11-2 to 11-7 is the same in Example 11 -1. Compositions of an ionizable gas filling is also the same in Example 11 -1 except a pressure of xenon (Xe) gas.

| Lamps | Pressure of xenon (Xe) gas |
|---|---|
| Example 11-2 | 5 atm |
| Example 11-3 | 7 atm |
| Example 11-4 | 9 atm |
| Example 11-5 | 11 atm |
| Example 11-6 | 13 atm |
| Example 11-7 | 15 atm |

The above formula is introduced by using both a filling pressure X (atm) of xenon (Xe) and a lamp power (W) of starting in Table 7. Each of Examples 11-1 to 11-7 in Table 7 shows lamp powers (W) of starting and xenon (Xe) gas pressure (atm), which can obtain a luminous intensity of 8000 cd in four seconds, after the lamp lit up. Each lamp has a lamp power of 40 W using a ballast generating frequency of 200 Hz. A vehicle lighting apparatus is required a luminous intensity of 8000 cd in four seconds, after the vehicle lighting apparatus turned on.

TABLE 7

| Lamps | Xenon (Xe) gas Pressure (atm) | Lamp Power (W) of starting |
|---|---|---|
| Example 11-1 | 3 | 95 |
| Example 11-2 | 5 | 90 |
| Example 11-3 | 7 | 85 |
| Example 11-4 | 9 | 80 |
| Example 11-5 | 11 | 75 |
| Example 11-6 | 13 | 70 |
| Example 11-7 | 15 | 65 |

Figure 15:
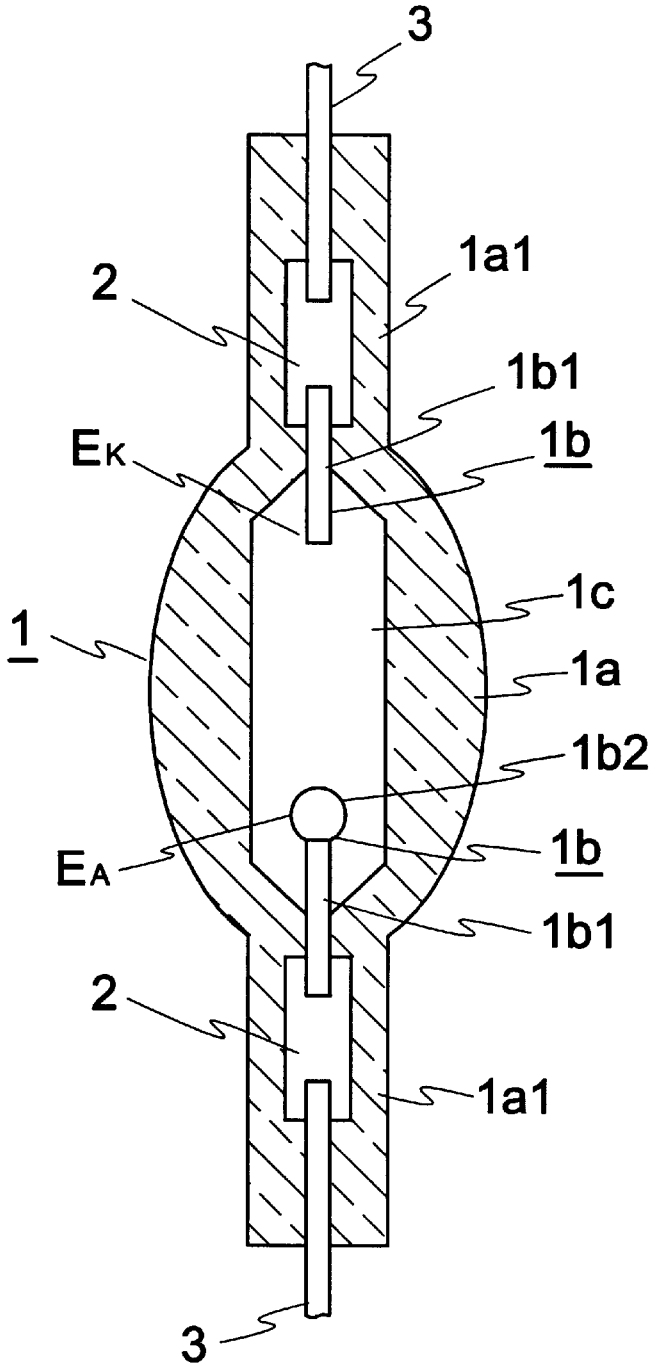
FIG. 15 is a longitudinal section of a metal halide lamp according to an eleventh embodiment of the present invention.

An eleventh exemplary embodiment of the invention will be explained hereinafter referring to FIG. 15, which shows a longitudinal section of a metal halide lamp. Similar reference characters designate identical or corresponding elements of the second embodiment in FIG. 6. Therefore, detail explanations will not be provided. This embodiment is different from the second embodiment at the point that the lamp is supplied direct current power. That is, one of electrodes is an anode EA, the other is a cathode EK. The anode EA comprises an electrode rod 1b1 having a diameter of 0.4 mm and a large tip portion 1b2 having a diameter of 0.9 mm. The cathode EK has an electrode rod 1b1 having a diameter of 0.4 mm. Followings are Example 12-D1, 12-D2, and Test Sample 12-E.

EXAMPLE 12-D1

A shape of the discharge vessel 1 is the same in FIG. 6. The discharge space 1c is nearly a cylindrical shape.

| Dimensions of discharge vessel | |
|---|---|
| Outer diameter at center | About 6.5 mm |
| Maximum inner diameter | About 3 mm |
| Interspace between tips | About 4.2 mm |
| Diameter of a rod of anode | About 0.4 mm |
| Length of a rod of anode | About 7 mm |
| Diameter of large tip portion of anode | About 0.9 mm |
| Diameter of a rod of cathode | About 0.4 mm |
| Length of a rod of cathode | About 7 mm |
| Compositions of ionizable filling | |
| Scandium iodide ($ScI_3$) as metal halide | About 0.2 mg |
| Sodium iodide (NaI) as metal halide | About 1 mg |
| Dysprosium iodide ($DyI_3$) as metal halid | About 0.05 mg |
| Xenon (Xe) gas as rare gas | About 8 atm |

EXAMPLE 12-D2, 12-D3, AND TEST SAMPLE 12-E

| | Example 12-D2 | Example 12-D3 | Test Sample 12-E |
|---|---|---|---|
| Dimensions of dicharge vessel | The same in Example 12-D1 | The same in Example 12-D1 | The same in Example 12-D1 |
| Compositions of ionizable gas filling | | | |
| Scandium iodide ($ScI_3$) as metal halide | 0.2 mg | 0.2 mg | 0.2 mg |
| Sodium iodide (NaI) as metal halide | 0.6 mg | 0.6 mg | 0.6 mg |
| Xenon (Xe) gas as rare gas | 8 atm | 8 atm | 8 atm |
| Dy prosium iodide ($DyI_3$) as metal halide | — | 0.6 mg | |
| Mercury (Hg) | — | — | 1 mg |

In this case, a color temperature is measured at around the anode EA and the cathode EK of the lamp, when the lamp is ignited at direct current supply of 40 W-lamp power. Results are as follows in Table 8.

TABLE 8

| | A color temperatures (K) | |
|---|---|---|
| Lamp | Around anode (EA) | Around cathode (EK) |
| Example 12-D1 | 4520 | 4150 |
| Example 12-D2 | 4210 | 3840 |
| Example 12-D3 | 4320 | 3950 |
| Test Sample 12-E | 5330 | 3720 |

According to Examples 12-D1 to 12-D3 in Table 8, the color temperature of adjacent to the anode (EA) is similar to that of the cathode (EK) comparatively, so that it is suitable for the vehicle lighting apparatus.

A lamp-life test was conducted by means of a conventional method, which is described by the JEL-215 appendix 4, 1998. An abstract of the method is that the test lamp is flashed ten times every one cycle having two hours. According to a result of the life test, about 70% of following Example 13-F were able to accomplish 2000 cycles, however, all of following Test sample 13-G cracked at sealed portions adjacent to the molybdenum foils connected to the anode EA, in 2000 cycles.

Detail dimensions of a discharge vessel and compositions of an ionizable gas filling will be described below in Example 13-F and Test Sample 13-G.

EXAMPLE 13-F, AMD TEST SAMPLE 13-G

Both Example 13-F and Test Sample 13-G are manufactured 20 each.

| | Exampls 13-F | Test Sample 13-G |
|---|---|---|
| Dimensions of discharge vessel | The same in Example 8-D1 | The same in Example 13-F |
| Compositions of ionizable filling | | |
| Scandium iodide ($ScI_3$) as metal halide | 0.2 mg | 0.2 mg |
| Sodium iodide (NaI) as metal halide | 1 mg | 1 mg |
| Dysprosium iodide ($DyI_3$) as metal halide | 0.05 mg | 0.05 mg |
| Zinc iodide ($ZnI_2$) as secondary metal halide | — | 0.4 mg |
| Xenon (Xe) gas as rare gas | 8 atm | 8 atm |

Next, dimensions of a discharge vessel and compositions of the ionizable gas filling will be described below in Example 14-H, Test Sample 14-I1, and 14-I2 in order to compare a luminous intensity (cd) in four seconds after lamps turning on.

EXAMPLE 14-H, TEST SAMPLE 14-I1, AND 14-I1

| | Example 14-H | Test Sample 14-I1 | Test Sample 14-I2 |
|---|---|---|---|
| Dimensions of discharge vessel | | The same in Example 14-H | The same in Example 14-H |
| Outer diamter at center | 6.5 mm | — | — |
| Inner maximum diamter | 3 mm | — | — |
| Interspace between tips | 4.2 mm | — | — |
| Diameter of electrode rod | 0.4 mm | — | — |
| Length of electrode rod | 7 mm | — | — |
| Diamter of large tip portion | 0.9 mm | — | — |
| Composition of ionizable filling | | | |
| Scandium iodide ($ScI_3$) as metal | 0.2 mg | 0.2 mg | 0.2 mg |

-continued

| | Example 14-H | Test Sample 14-I1 | Test Sample 14-I2 |
|---|---|---|---|
| halide | | | |
| Sodium iodide (NaI) as metal halide | 1 mg | 1 mg | 1 mg |
| Dysprosium iodide ($DyI_3$) as metal halide | 0.05 mg | — | — |
| Zinc iodide ($ZnI_2$) as secondary metal halide | — | 0.4 mg | — |
| Maganese iodide ($MnI_2$) as secondary metal halide | — | — | 0.4 mg |
| Xenon (Xe) gas as rare gas | 8 atm | 8 atm | 8 atm |

A total luminous flux in steady-state, a total luminous flux four seconds later, and a luminous intensity four seconds later are described in Table 9 for the lamps, which have a lamp power of 40 W using a ballast generating frequency of 200 Hz, turned on. In this embodiment, the total luminous flux (lm) and the luminous intensity (cd) in Example 14-H are suitable for a vehicle lighting apparatus.

TABLE 9

| Lamps | Example 14-H | Test Sample 14-I1 | Test Sample 14-I2 |
|---|---|---|---|
| Total luminous flux (lm) in steady-state | 3400 | 3320 | 3350 |
| Total luminous flux (lm), four Seconds later | 2560 | 2830 | 2650 |
| Luminous intensity (cd), Four seconds later | 12900 | 7800 | 8300 |

Figure 16:
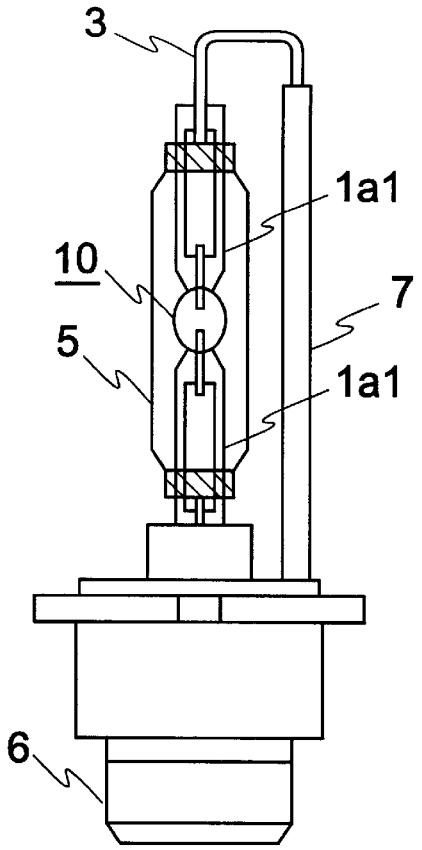
FIG. 16 is a side view of a metal halide lamp assembly.

Referring to FIG. 16, an exemplary embodiment of a metal halide lamp assembly will be described hereinafter. The metal halide lamp assembly shown in FIG. 16 is provided with an above-mentioned metal halide lamp 10 accommodated an outer bulb 5, and a lamp cap 6 connecting to a conductive wire 7 having an electrical insulator. The assembly can be used as part of a vehicle lighting apparatus. The outer bulb 5 can cut off ultraviolet rays. Air filling in the outer bulb 5 may flow outwardly. The outer bulb 5 may be a vacuum or it may be filled with an inert gas.

When a metal halide lamp assembly is used in a vehicle lighting apparatus, the apparatus must be able to pass a brightness on a screen test which indicates that required levels of luminous flux can be achieved within predetermined times after the vehicle lighting apparatus turned on. For example, according to JEL-215, the lamp for the vehicle lighting apparatus has a rated luminous flux of 25% in one second after the lamp turned on, and has the rated luminous flux of 80% in four seconds after the lamp turned on. After the lamp lit up, rare gas immediately and primarily illuminates. Luminescence metals comprising metal halide illuminates partially. After a while, luminescence metals illuminate sharply, so that luminous flux increases in proportion to the luminescence. Eventually, the lamp lights up stably. The lamp may light up a rated luminous flux of 25% or more in one second after the lamp lit up by adjusting the power supply. Particularly, in 0.3 seconds after the lamp started, a rate of increase of the luminous flux becomes remarkably high, i.e., several times or more in comparison with that of the lamp including mercury (Hg).

Figure 17:
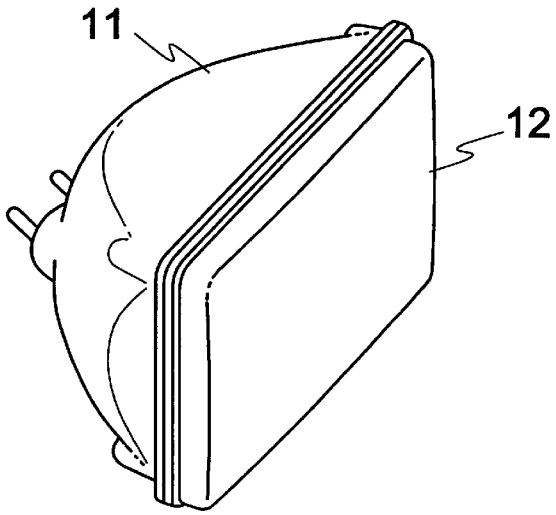
FIG. 17 is a perspective view of a vehicle lighting apparatus.

A vehicle lighting apparatus using a metal halide lamp is shown in FIG. 17. The lighting apparatus has a reflector 11, and a front cover 12 made of transparent plastics. The front cover 12, which can control a light generated from the lamp, is disposed at an opening of the reflector 11 in an airtight arrangement. The reflector 11, made of plastics, is shaped into a deformed parabolic mirror, and accommodates the lamp.

Figure 18:
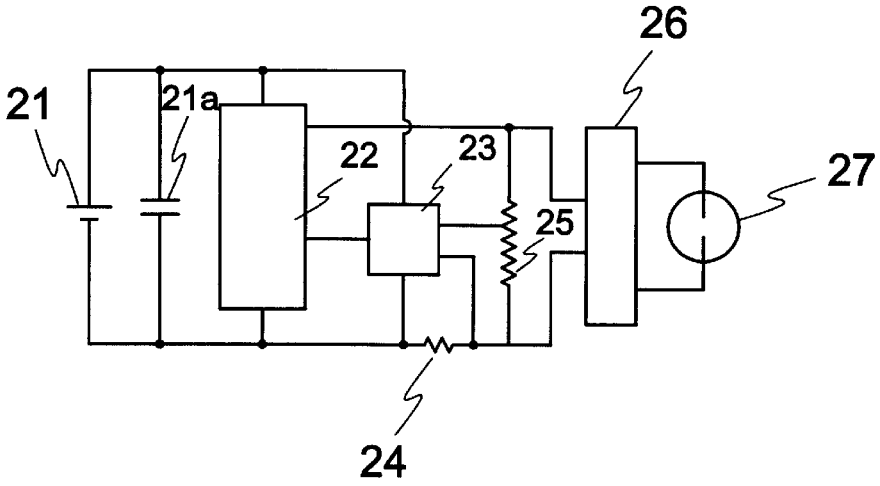
FIG. 18 is a circuit diagram of an electric ballast to start a metal halide lamp.

FIG. 18 shows a circuit diagram of the first embodiment of an electric ballast to start a metal halide lamp, such as the ones previously described. The circuit arrangement comprises a direct current (DC) power supply 21, a chopper circuit 22, a controlling means 23, a lamp current detecting means 24, a lamp voltage detecting means 25 for detecting a lamp voltage, and an igniter applying a pulse voltage of 20 KV to a metal halide lamp.

The DC power supply may utilize a battery, or a full-wave rectifier to convert AC power supply to DC. The chopper circuit 22 transforms a DC voltage into a required output voltage. The controlling means 23 lets the chopper circuit 22 generate three times of a rated lamp current. After the lamp lit up, the lamp current is lowered so as to become the rated lamp current by the chopper circuit 22. The controlling means 23 receives detected signals generated by the lamp current detecting means 24 and the lamp voltage detecting means 25, whose detecting range can be set up to 60V or less. The lamp voltage can be decreased in comparison to that of a metal halide lamp having mercury (Hg).

A metal halide lamp not including mercury (Hg) tends to have a lower lamp voltage. The lamp loses electrical energy at the electrodes. Generally, such energy loss is related to the anode and cathode drop voltage. The electrode drop voltage of the general metal halide lamp is about 15V. The lamp voltage of the metal halide lamp including mercury (Hg) is about 85V. The rate of electrode loss is 17.6%. However, the lamp voltage of the metal halide lamp not including mercury (Hg) is about 35V. The electrode drop voltage of the lamp not including mercury (Hg) is about 7V. The rate of electrode loss is 20%. Accordingly, a lamp efficacy of the metal halide lamp not including mercury (Hg) is almost the same as that of the lamp including mercury (Hg). Since the lamp voltage lowers, an output voltage, which is measured not loading the lamp, can be decreased to 300V or less. Therefore, the circuit can be made small.

The controlling means 23 may comprise a microcomputer programming the above-described lamp lighting method. When the vehicle lighting apparatus using the metal halide lamp turned on, the lamp can light up at a rated luminous flux of 25% one second later, and at a rated luminous flux of 80% four seconds later, respectively. In this case, the circuit can be manufactured at a cost of 70% and at a weight of 85% compared an arrangement using AC power because of it is not necessary to include a DC-AC converter. Furthermore, since the lamp does not substantially include mercury (Hg), mercury (Hg) does not luminescent strongly at the side of anode. Therefore, a color of visible light generated by the lamp becomes even.

Figure 19:
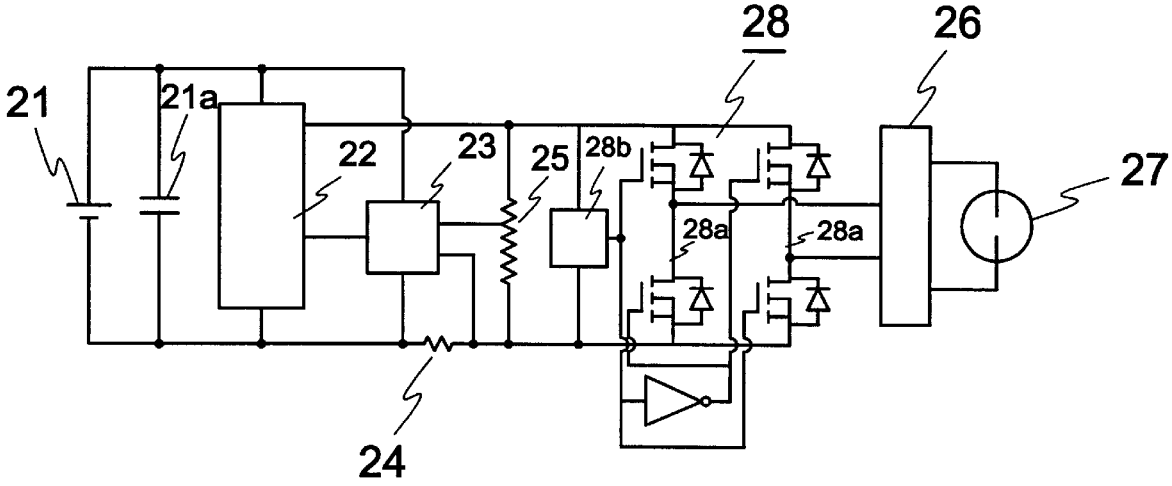
FIG. 19 is another circuit diagram of an electric ballast to start a metal halide lamp.

FIG. 19 shows a circuit diagram of a second embodiment of an electric ballast to start a metal halide lamp. Similar reference characters designate identical or corresponding to the elements described with respect to FIG. 18. Therefore, detail descriptions will not be provided. The circuit arrangement includes a full-bridge inverter circuit 28 made up four switching elements. A pair of switching elements 28*a* is connected to output terminals of a chopper circuit 22 in parallel. An oscillator 28*b* alternately supplies pulses to the switching elements 28*a*. Therefore, the lamp is supplied a high frequency alternating current.

What is claimed is:

1. A metal halide lamp comprising:

a light-transmitting discharge vessel having a discharge space portion, a sealed portion, a pair of electrodes projecting into the discharge space, the lamp being constructed and arranged so as to have a D/L ratio in a range of about 0.25 to about 1.5 and a t/L ratio being in a range of about 0.16 to about 1.1, wherein L is an interspace of tips of the electrodes, D is a maximum inner diameter of the discharge vessel, and t is a maximum wall thickness of the discharge space portion;

an ionizable filling the discharge space portion, which contains a rare gas and a metal halide including at least sodium (Na) or scandium (Sc) and does not substantially include mercury (Hg); and a conductive wires connected electrically to each electrodes, the conductive wires extending from the discharge vessel.

2. The metal halide lamp according to claim 1, wherein a quantity of the ionizable filling in the discharge vessel corresponds to a formula: $q \leqq 71.4/t$, wherein q is a quantity (mg) per a volume of 1 (cc) of the discharge space.

3. The metal halide lamp according to claim 1, wherein both an inner diameter ID (mm) and an outer diameter OD (mm) of the discharge vessel and a lamp power P (W) satisfy the following formula: $(OD-ID)*ID/P>0.21$.

4. The metal halide lamp according to claim 1, wherein a pressure A (atm) at 25 degrees centigrade of xenon (Xe) and the interspace L (mm) are related according to the following formula: $1.04 \leqq A/L \leqq 4$; and the ionizable filling further comprises a secondary metal halide not easily emitting visible light in comparison with the metal halide during lamp operation.

5. The metal halide lamp according to claim 1, wherein the interspace L (mm) is about 6 mm or less; and the ionizable filling further comprises one or more substance selected a group of rare earth elements.

6. A metal halide lamp apparatus comprising:

a metal halide lamp comprising: a light-transmitting discharge vessel having a discharge space portion, a sealed portion, a pair of electrodes projecting into the discharge space, the lamp being constructed and arranged so that it has a D/L ratio in a range of about 0.25 to about 1.5 and a t/L ratio being in a range of about 0.16 to about 1.1, wherein L is an interspace of tips of the electrodes, D is a maximum inner diameter of the discharge vessel, and t is a maximum wall thickness of the discharge space portion; an ionizable filling in the discharge space portion, which contains xenon (Xe) gas and a metal halide including at least sodium (Na) or scandium (Sc) and does not substantially include mercury (Hg); and a conductive wire connected electrically to each of the electrodes, the conductive wires extending from the discharge vessel; and a ballast constructed and arranged so as to have a relation between a filling pressure X (atm) of the xenon (Xe) and a maximum electrical power AA (W) provided to a following formula: $3<X<15$, $AA \geqq -2.5X+102.5$, wherein the maximum electrical power AA (W) is a maximum wattage supplied to the metal halide lamp in four seconds after the lamp turned on.

7. The metal halide lamp apparatus according to claim 6, wherein the ballast supplies a direct current to the metal halide lamp.

8. The metal halide lamp apparatus according to claim 6, wherein the ballast further comprises:

a lamp voltage detecting means for detecting a lamp voltage of about 60V or less; and a controlling means for maintaining a lamp electric power according to a detected signal generated by the lamp voltage detecting means.

9. The metal halide lamp apparatus according to claim 6, wherein the ballast has an output voltage of about 300V or less when the ballast does not load the metal halide lamp.

10. A vehicle lighting apparatus comprising:

a reflector having an opening and accommodating a metal halide lamp; wherein the metal halide lamp comprises:

a light-transmitting discharge vessel having a discharge space portion, a sealed portion, a pair of electrodes projecting into the discharge space, the lamp being constructed and arranged such that a D/L ratio is in a range of about 0.25 to about 1.5 and a t/L ratio being in a range of about 0.16 to about 1.1, wherein L is an interspace of tips of the electrodes, D is a maximum inner diameter of the discharge vessel, and t is a maximum wall thickness of the discharge space portion; an ionizable filling in the discharge space, which contains xenon (Xe) gas and a metal halide including at least sodium (Na) or scandium (Sc) and does not substantially include mercury (Hg); and a conductive wire connected electrically to each electrode, the conductive wires extending from the discharge vessel;

a front cover attached to the opening of the reflector; and a ballast constructed and arranged to have a relation between a filling pressure X (atm) of the xenon (Xe) and a maximum electrical power AA (W) that is in accordance with the following formula:

$$3<X<15, AA \geqq -2.5X+102.5,$$

wherein the maximum electrical power AA (W) is a maximum wattage supplied to the metal halide lamp in four seconds after the lamp turned on.

* * * * *